US009184507B2

(12) United States Patent
Honda et al.

(10) Patent No.: US 9,184,507 B2
(45) Date of Patent: Nov. 10, 2015

(54) MULTI-SLOT COMMON APERTURE DUAL POLARIZED OMNI-DIRECTIONAL ANTENNA

(71) Applicant: LHC2 INC, Liberty Lake, WA (US)

(72) Inventors: Royden M. Honda, Post Falls, ID (US); Robert J. Conley, Liberty Lake, WA (US); Jon Thorpe, Liberty Lake, WA (US)

(73) Assignee: LHC2 INC, Liberty Lake, WA (US)

( * ) Notice: Subject to any disclaimer, the term of this patent is extended or adjusted under 35 U.S.C. 154(b) by 252 days.

(21) Appl. No.: 13/839,839

(22) Filed: Mar. 15, 2013

(65) Prior Publication Data

US 2013/0249756 A1 Sep. 26, 2013

Related U.S. Application Data

(60) Provisional application No. 61/615,006, filed on Mar. 23, 2012.

(51) Int. Cl.
*H01Q 13/12* (2006.01)
*H01Q 21/00* (2006.01)
*H01Q 21/20* (2006.01)

(52) U.S. Cl.
CPC ..... *H01Q 13/12* (2013.01); *H01Q 21/00* (2013.01); *H01Q 21/20* (2013.01)

(58) Field of Classification Search
CPC ..... H01Q 13/12; H01Q 21/00
USPC ..... 343/767, 770, 771
See application file for complete search history.

(56) References Cited

U.S. PATENT DOCUMENTS

| | | | | |
|---|---|---|---|---|
| 2,507,528 | A * | 5/1950 | Kandoian | 343/767 |
| 2,557,951 | A * | 6/1951 | Capen et al. | 343/770 |
| 3,039,098 | A * | 6/1962 | Bickmore | 343/771 |
| 5,619,216 | A * | 4/1997 | Park | 343/771 |
| 6,480,162 | B2 * | 11/2002 | Sabet et al. | 343/767 |
| 6,731,241 | B2 * | 5/2004 | Park et al. | 342/361 |

* cited by examiner

*Primary Examiner* — Tho G Phan
(74) *Attorney, Agent, or Firm* — Lee & Hayes, PLLC

(57) ABSTRACT

Horizontally polarized and dual polarized antennas are described herein. In some examples, a horizontally polarized and dual polarized antenna may be mounted or operated with the physical vertical axis of the antenna being substantially perpendicular to a plane defined by the surface of the earth, and emanate an electric field that is parallel to the surface of the earth. The antenna may have a multi-slot aperture that reduces a variation in the far field omni-directional pattern. The antenna may have various cross-sectional configurations, and may have a radome at least partially surrounding the antenna and a supporting structure.

14 Claims, 31 Drawing Sheets

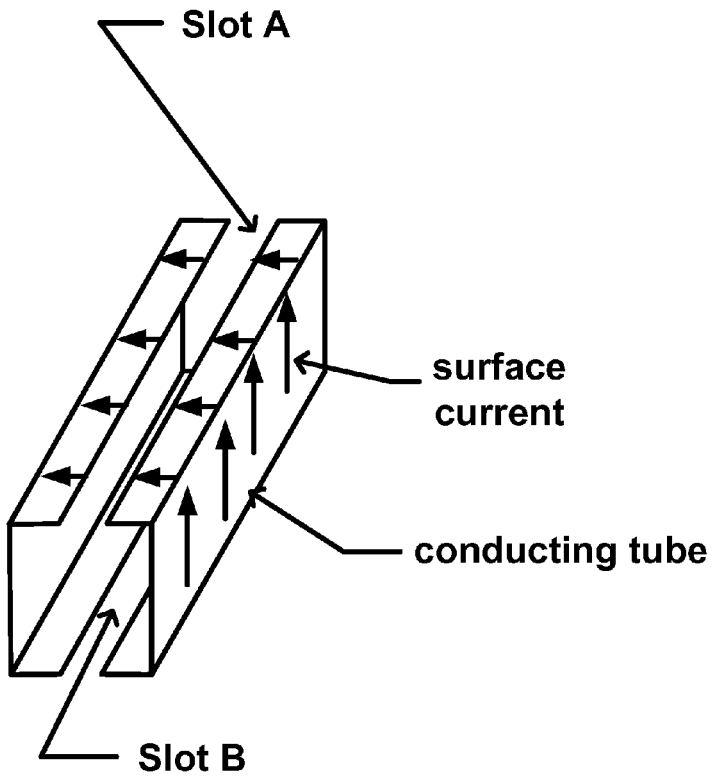
Figure 1. Surface current flow around the tube surface

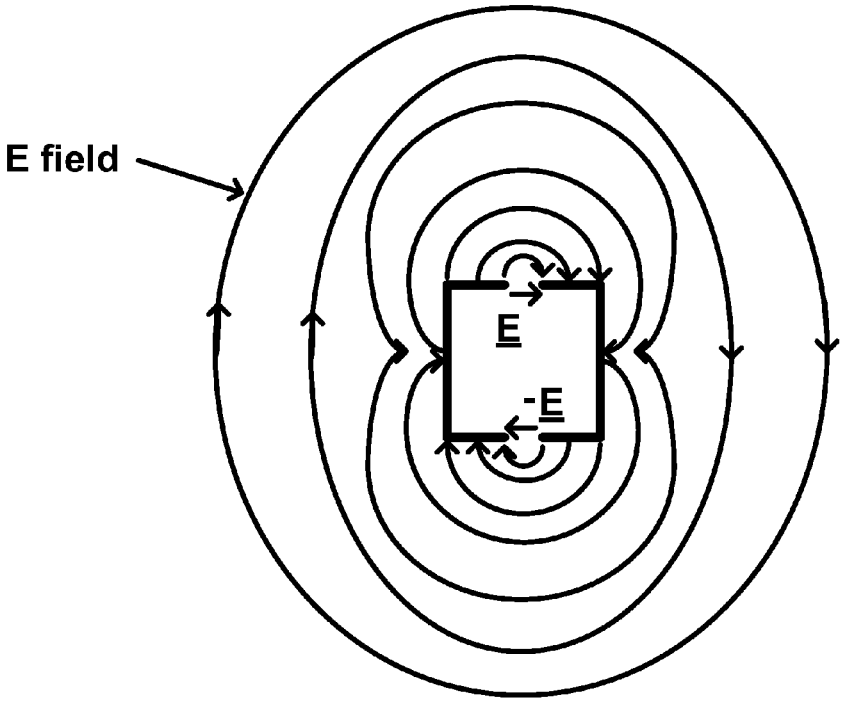
Figure 2. E field expansion around the two slots

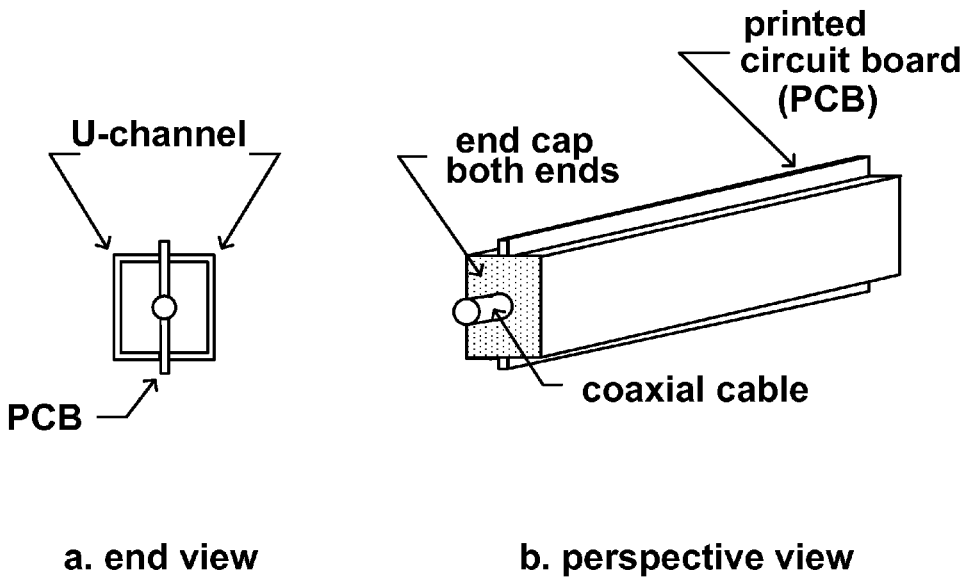
Figure 3. Two-slot antenna assembly

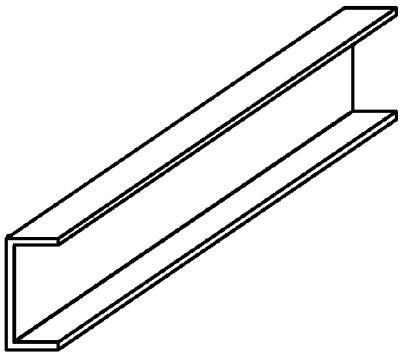
a. U-channel
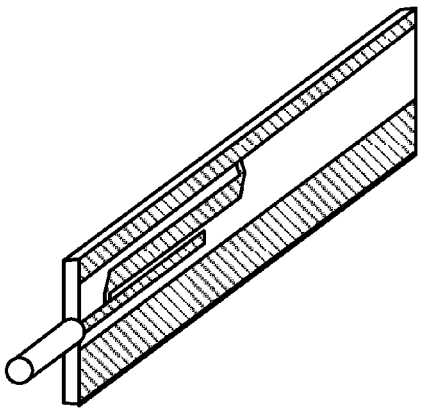
b. Support structure
Figure 4. Elements of a Two-slot Antenna

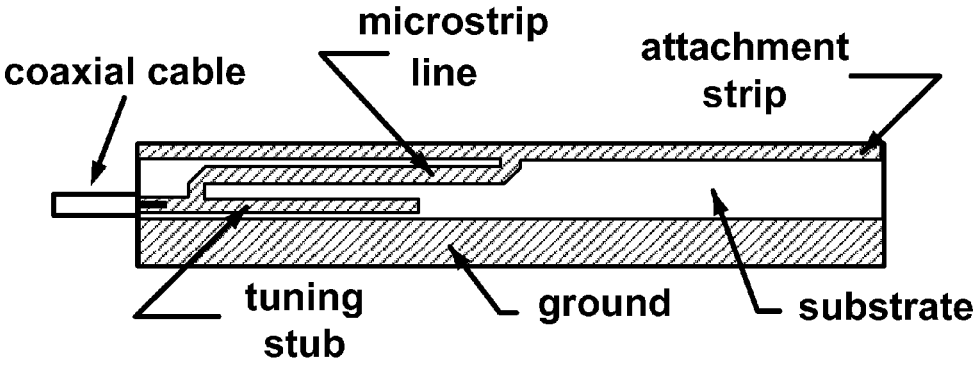
a. Traces on one side of a support structure
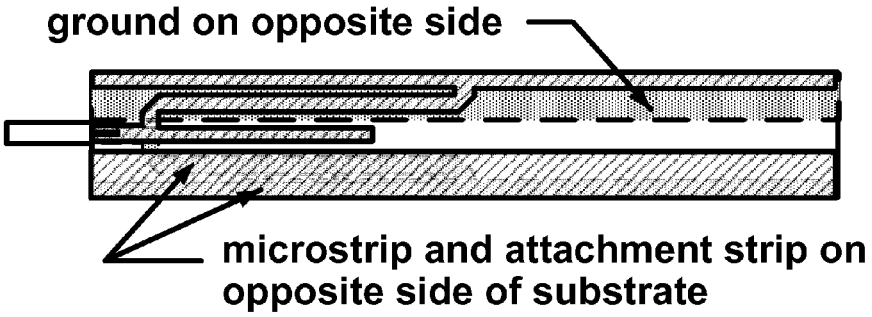
b. Mirror image traces on other side of the support structure
Figure 5. A microstrip feeding technique on a support structure

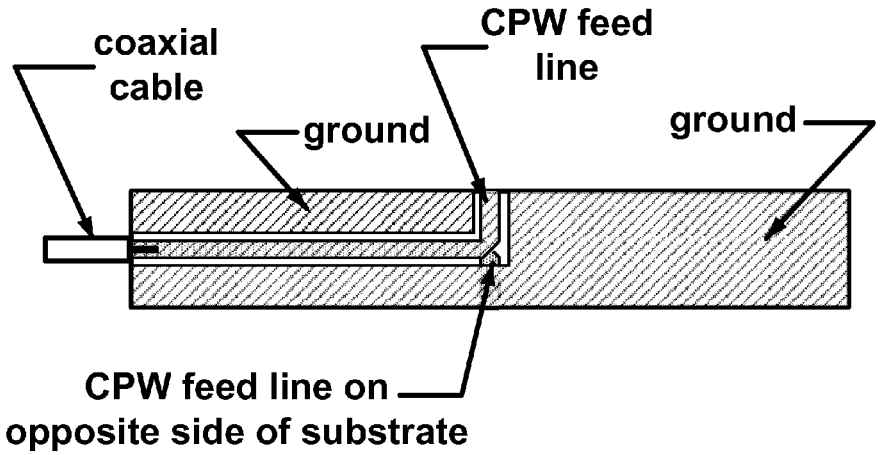
a. side view
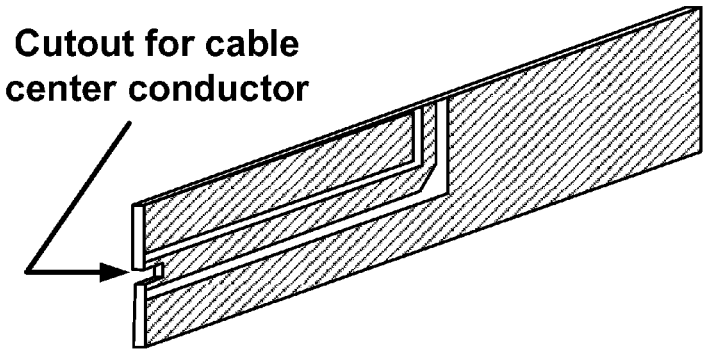
b. perspective view
Figure 6. Modified CPW support structure

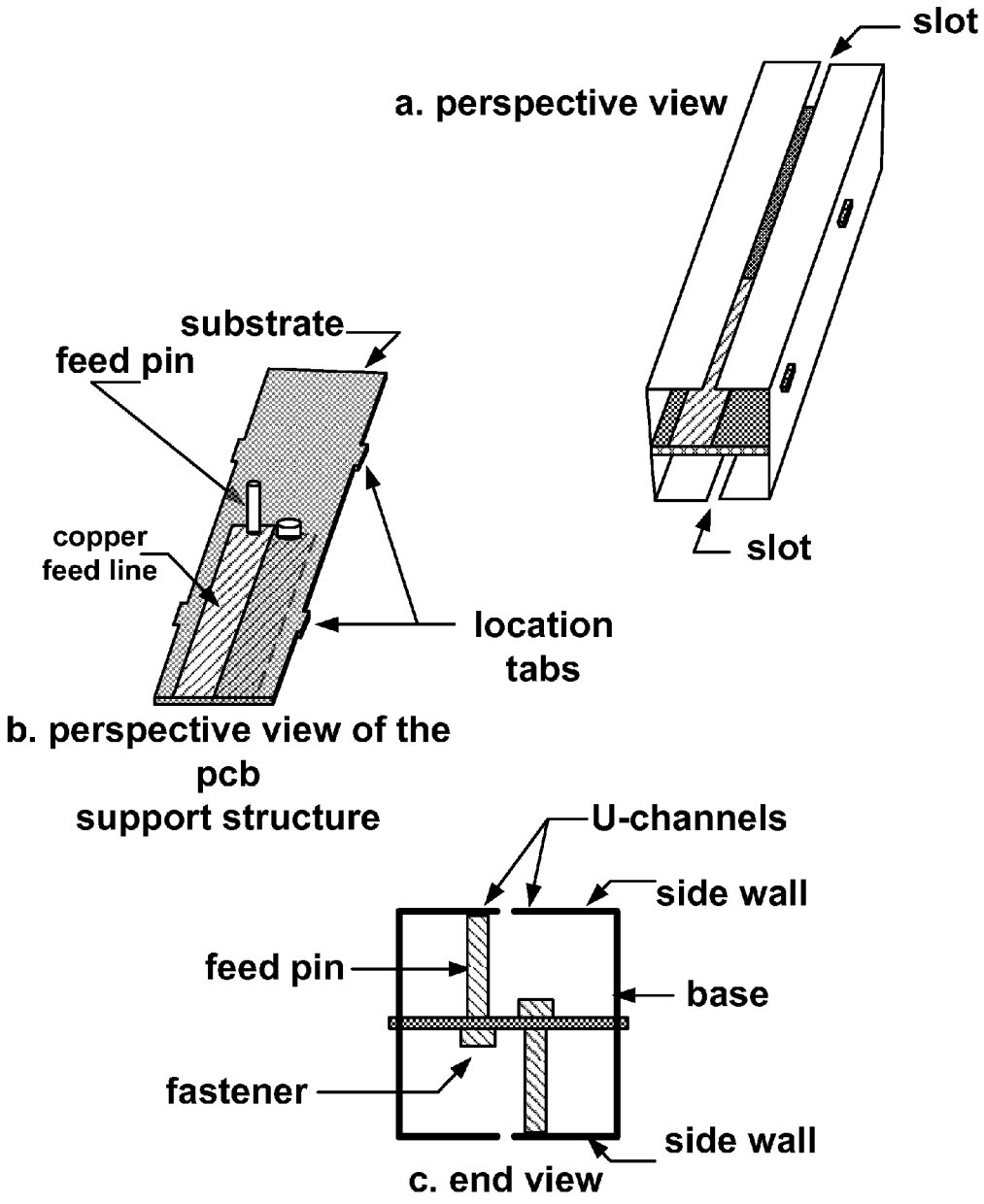
Figure 7. PCB supported pin fed Two-slot antenna

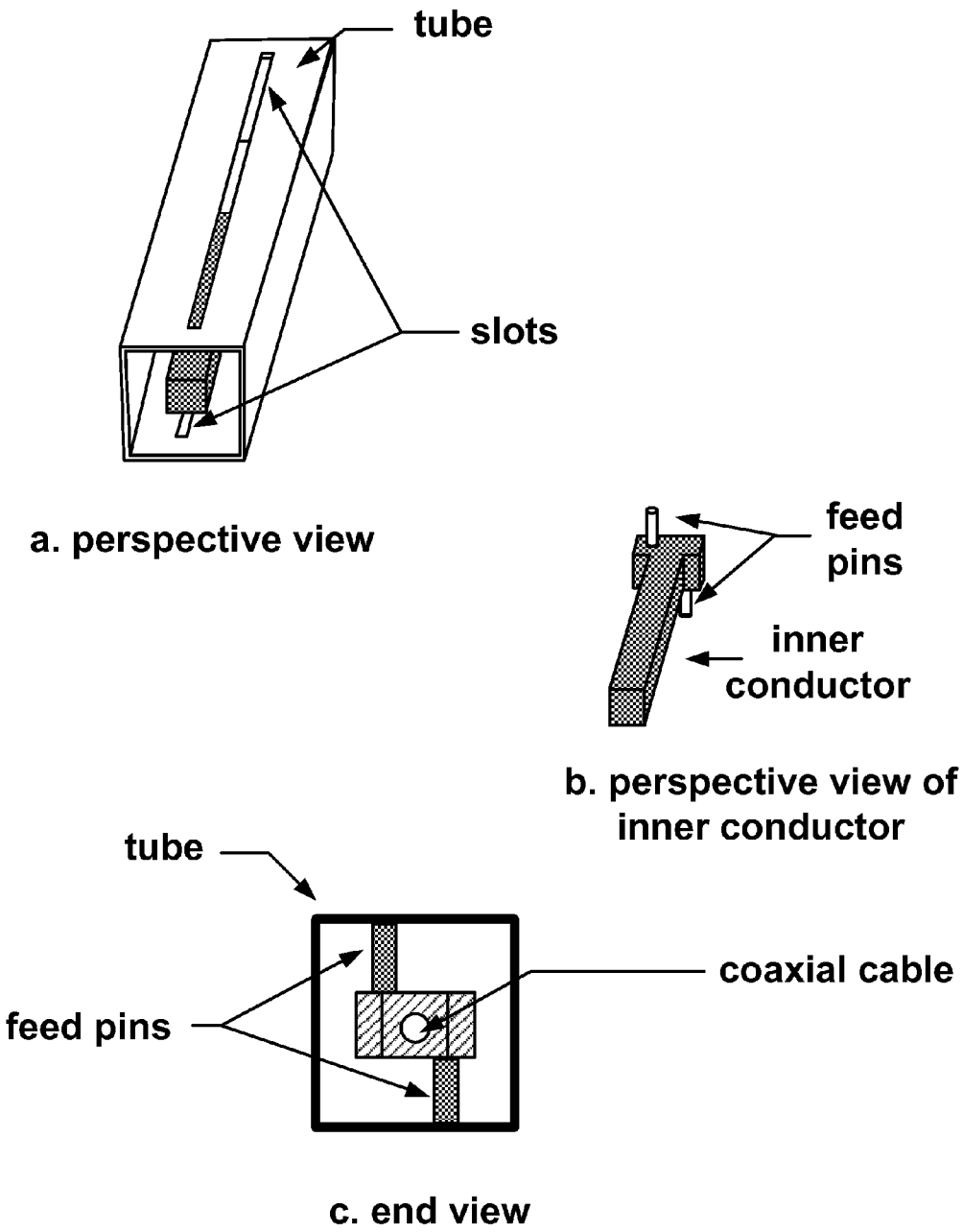
Figure 8. Coaxial two-slot tube antenna

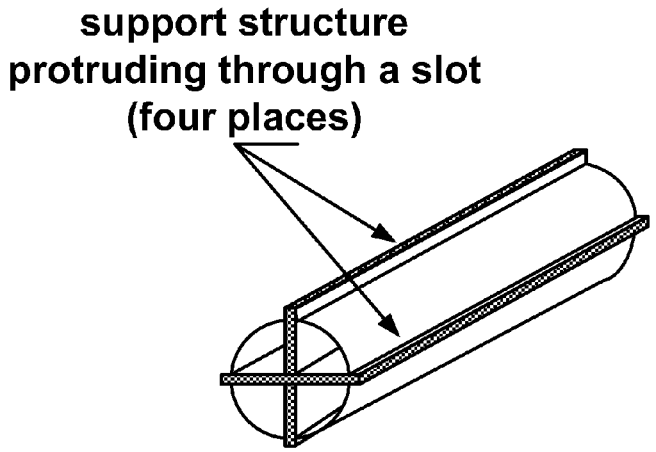
a. circular cross-section
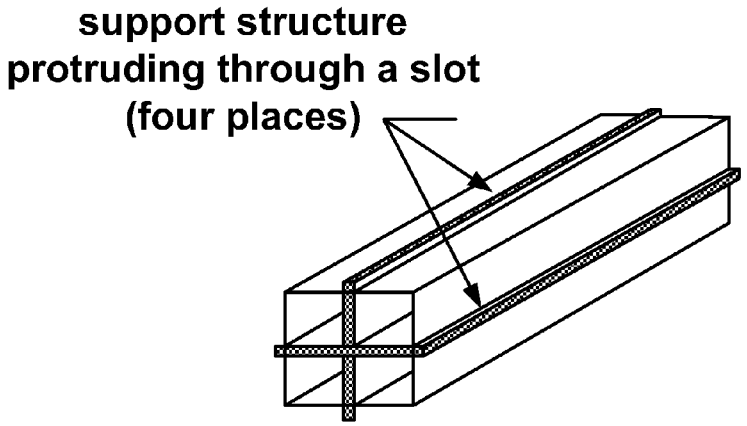
b. square cross-section
Figure 9. Four-slot embodiment

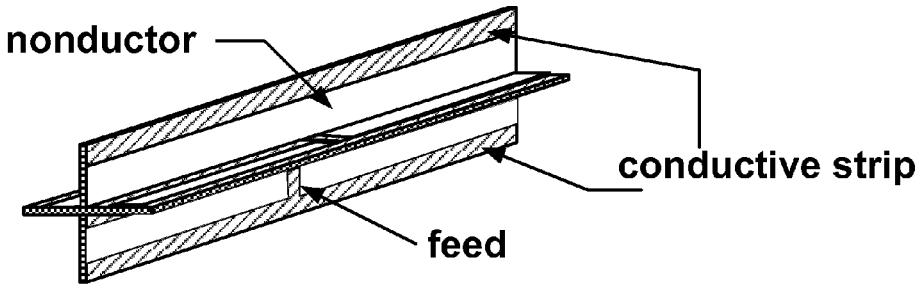
a. assembled support structure
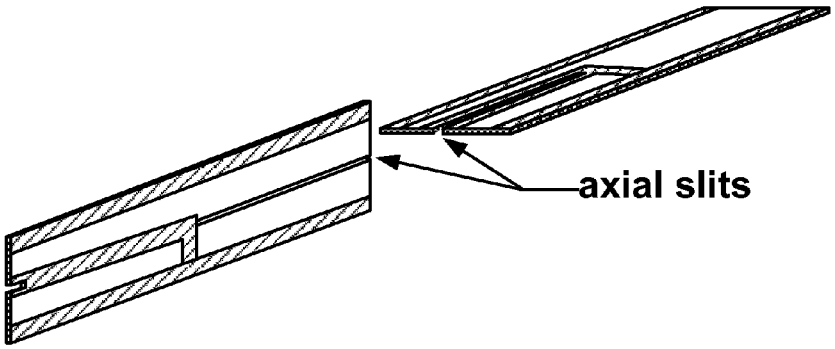
b. disassembled support structure
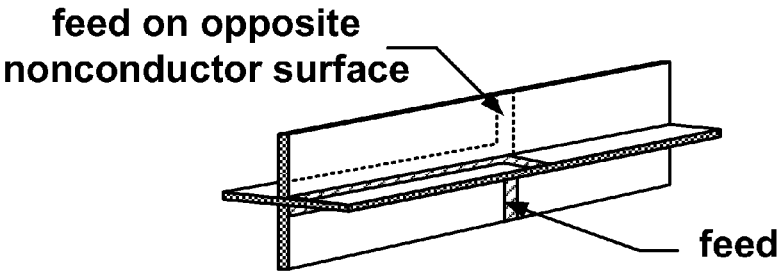
c. assembled support structure w/o optional conducting strip
Figure 10. Four-port support structure embodiment

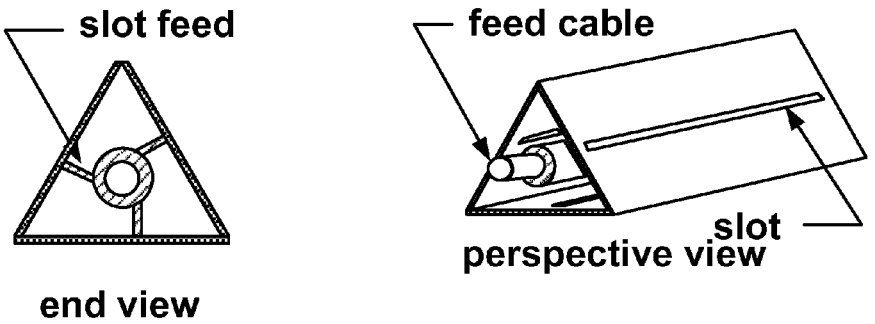
a. triangular cross-section
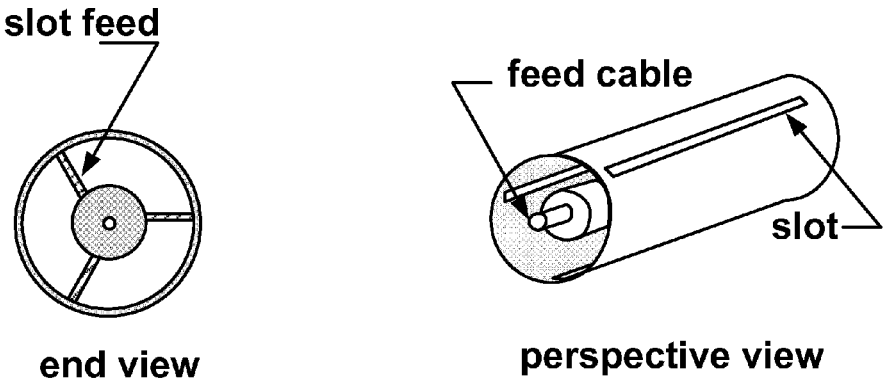
b. circular cross-section
Figure 11. Tri-slot embodiment

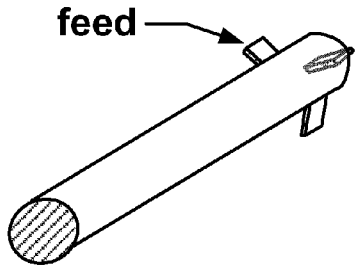
a. circular rod configuration
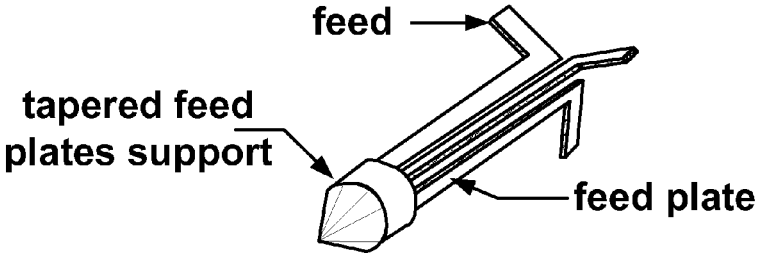
b. thin plate configuration
Figure 12. Tri-slot feed embodiment

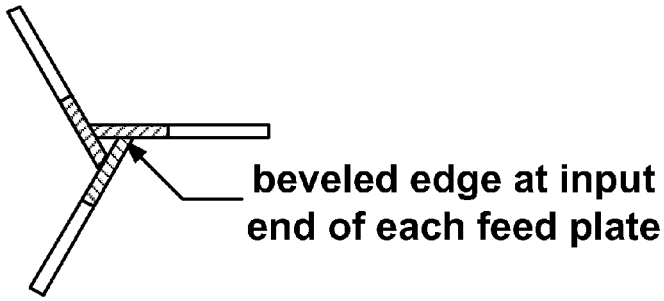
a. input end view
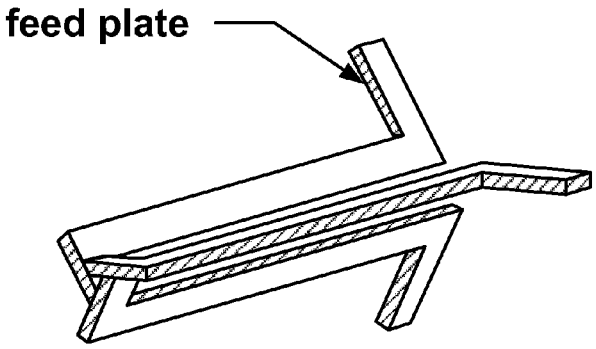
b. perspective view
Figure 13. Tri-slot feed plate embodiment
w/o feed plate support

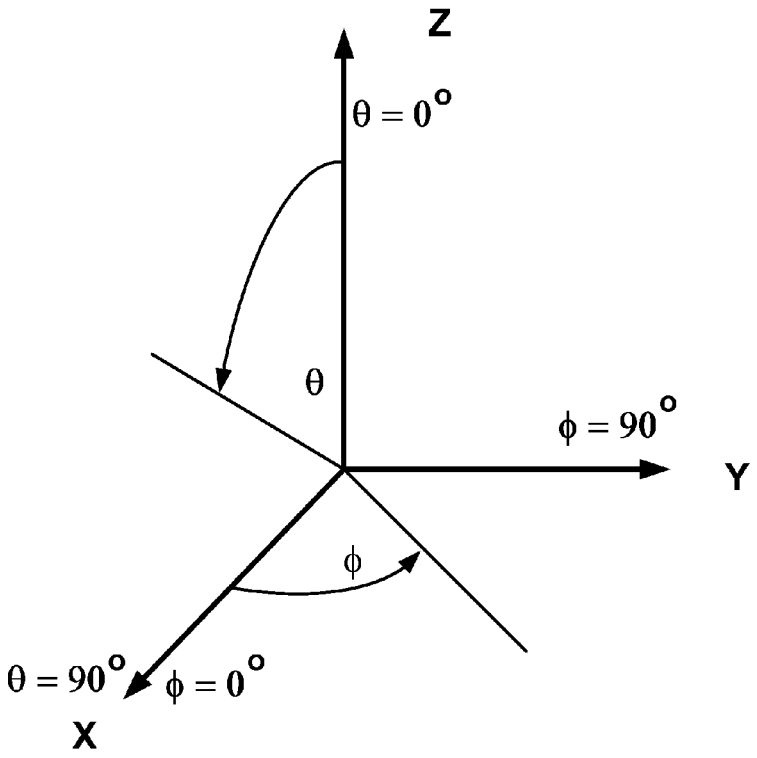
Figure 14. 3-dimensional coordinate system

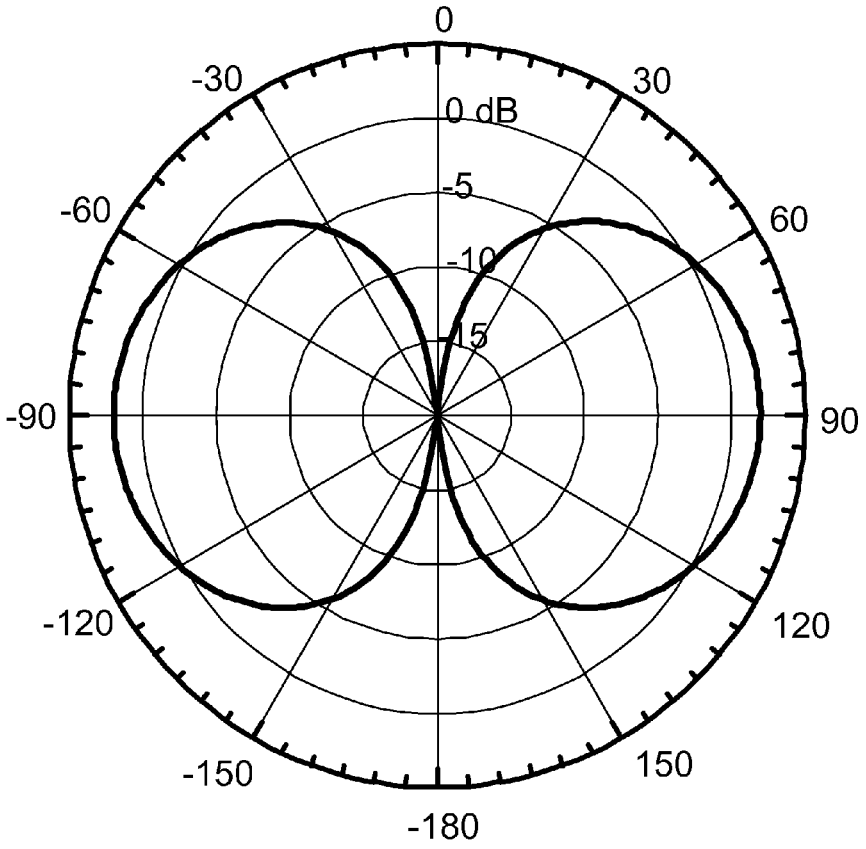
Figure 15. Two-slot antenna elevation far field pattern

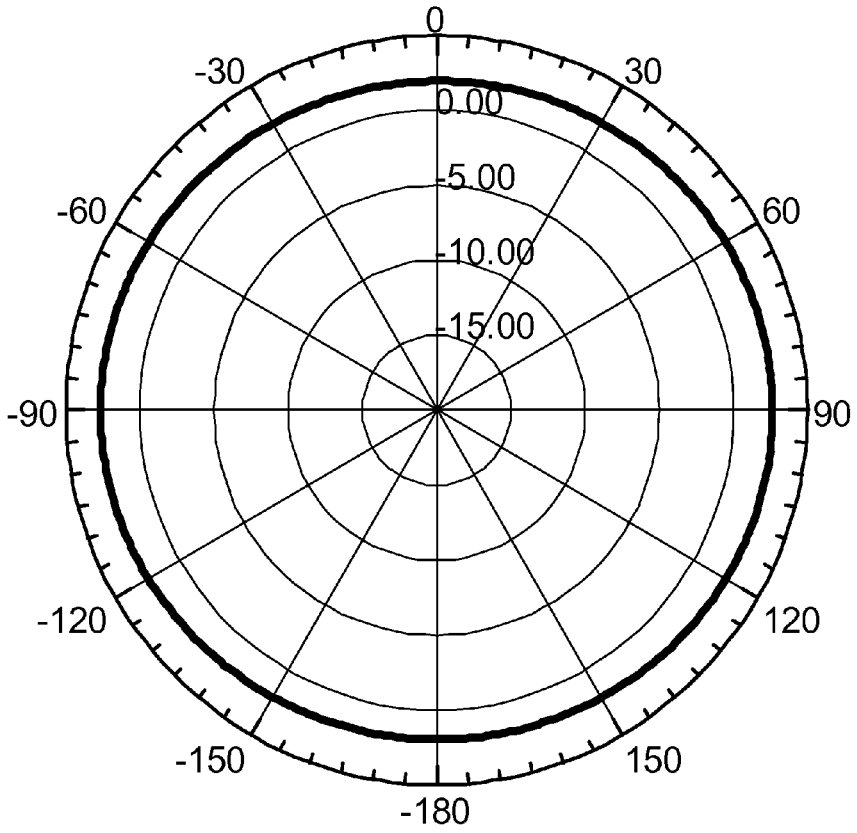
Figure 16. Two-slot antenna azimuth far field pattern

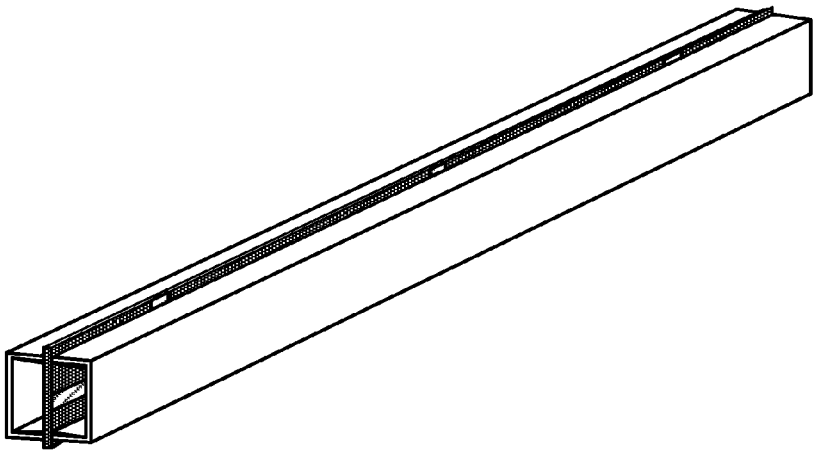
a. Perspective view of antenna assembly
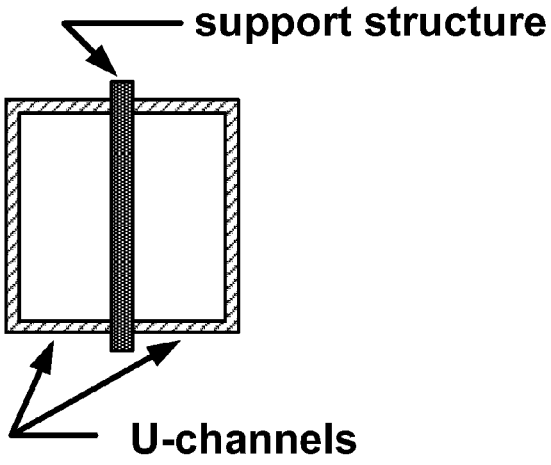
b. End view
Figure 17. High gain two-slot antenna

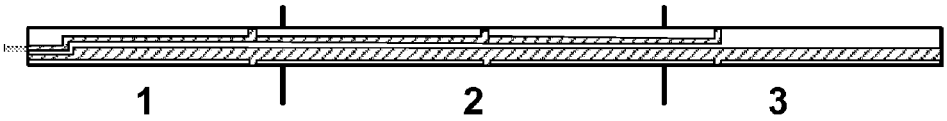
a. Microstrip series feed support structure
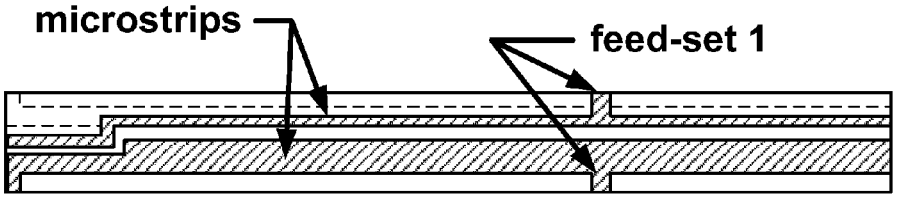
b. Input section (1)
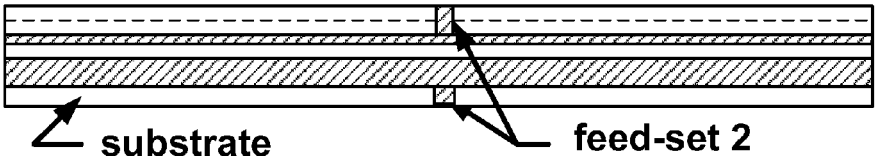
c. Mid section (2)
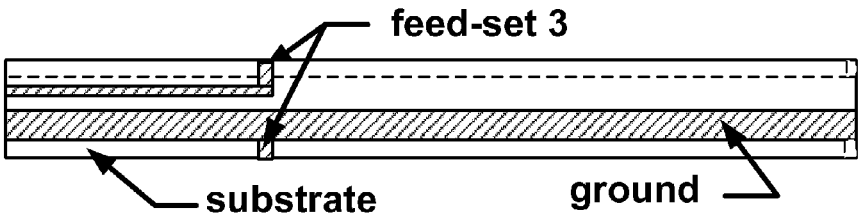
d. End section (3)
Figure 18. High gain two-slot antenna support structure

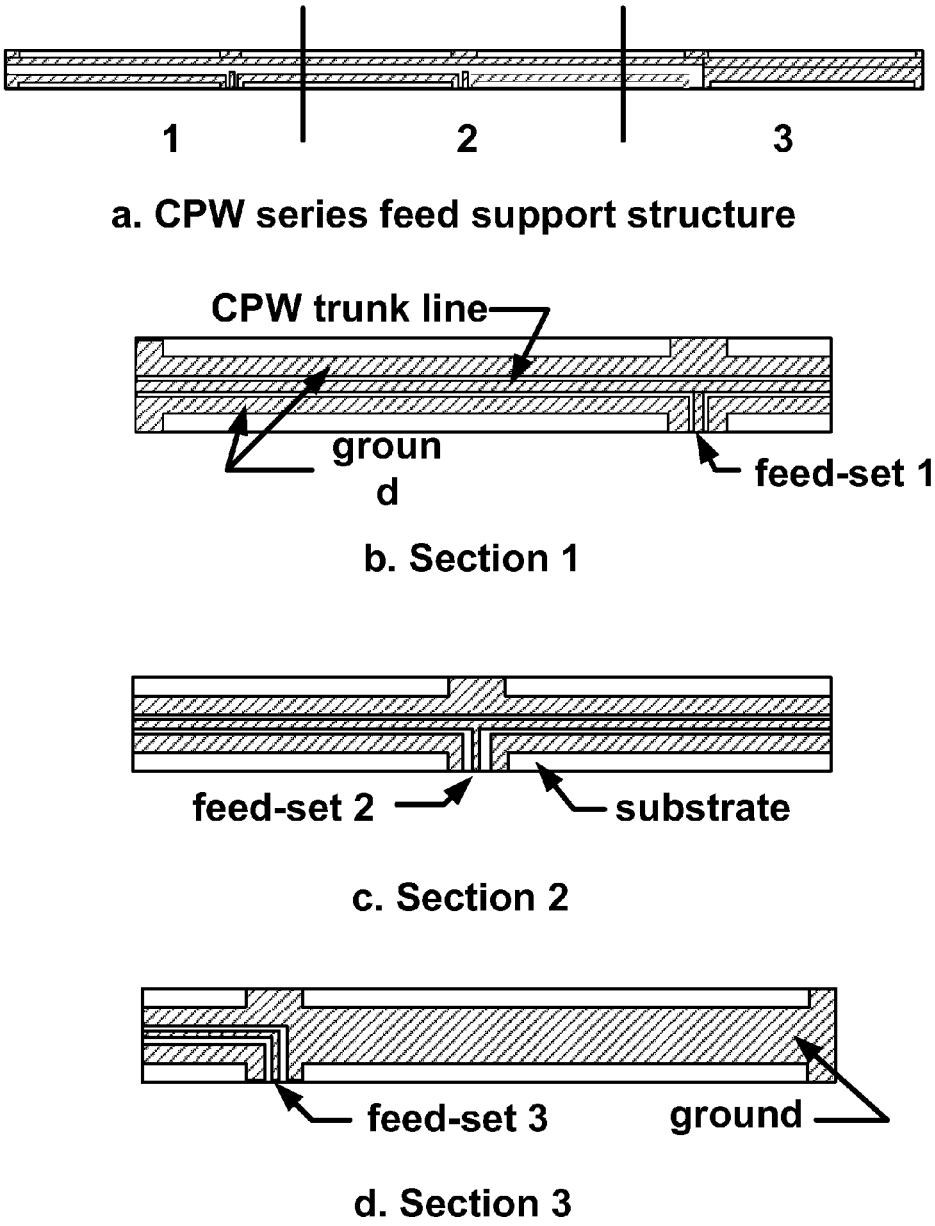
Figure 19. High gain two-slot antenna CPW support structure

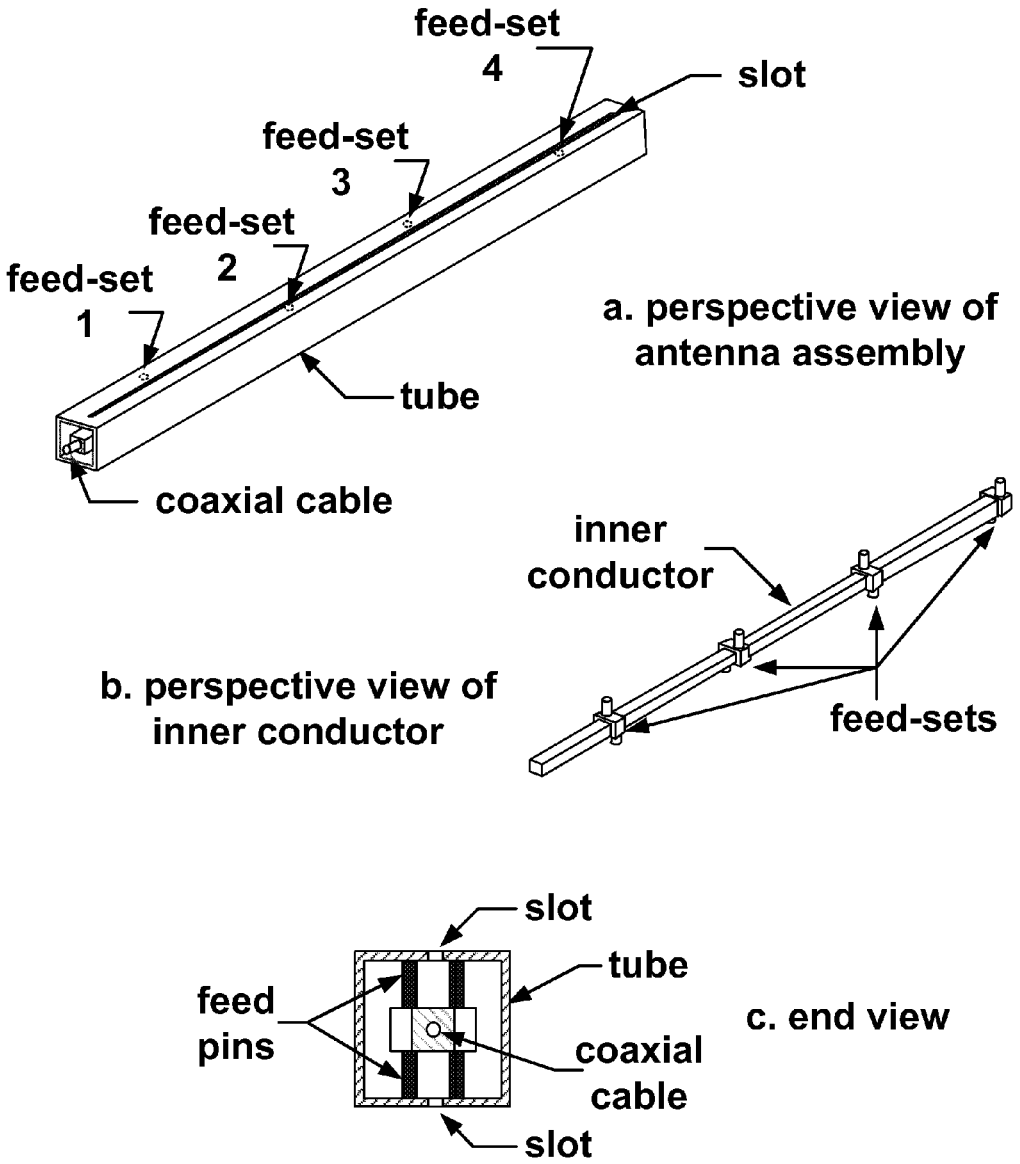
Figure 20. High gain coaxial two-slot tube antenna

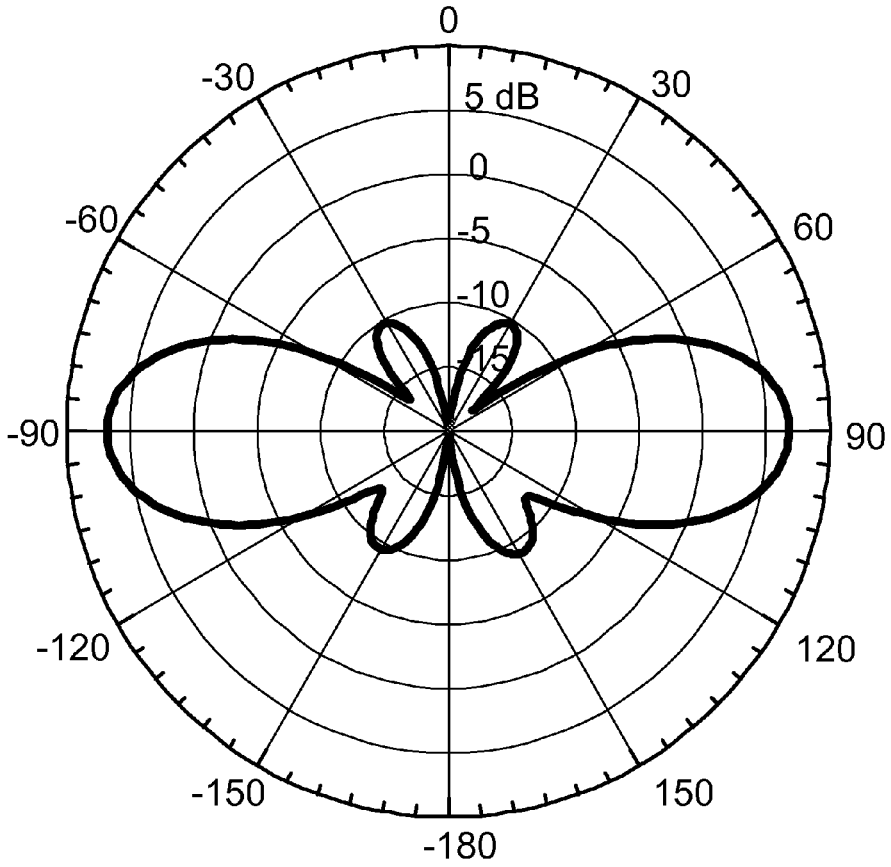
Figure 21. High gain two-slot antenna elevation pattern

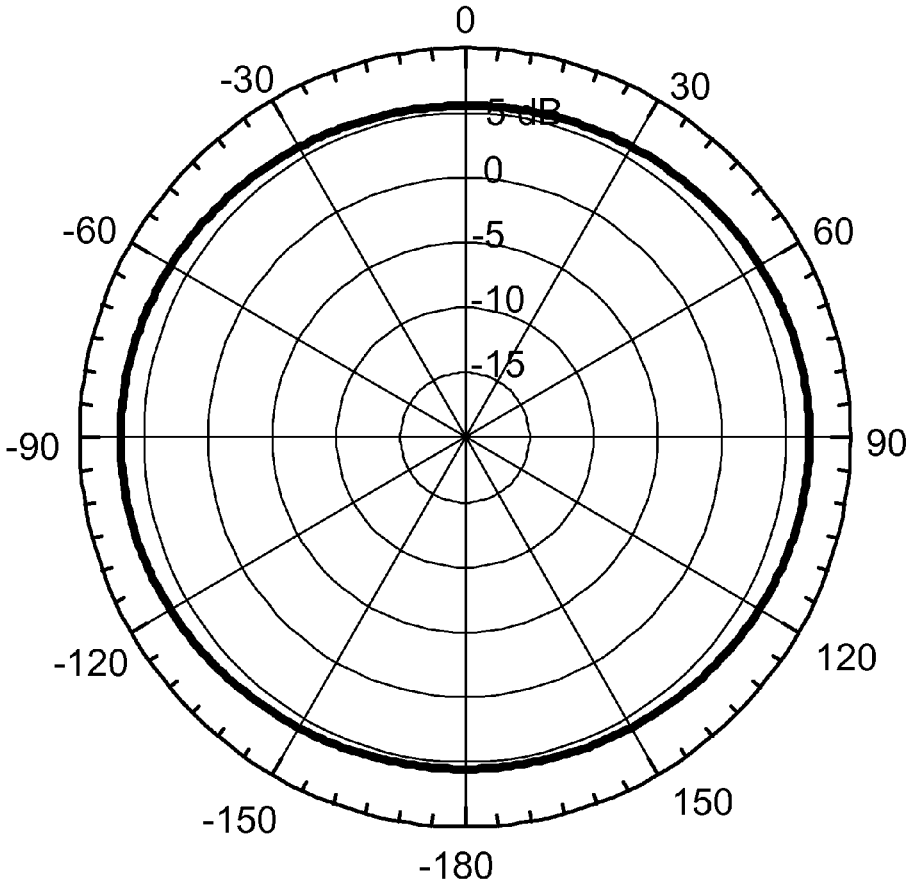
Figure 22. High gain two-slot antenna azimuth pattern

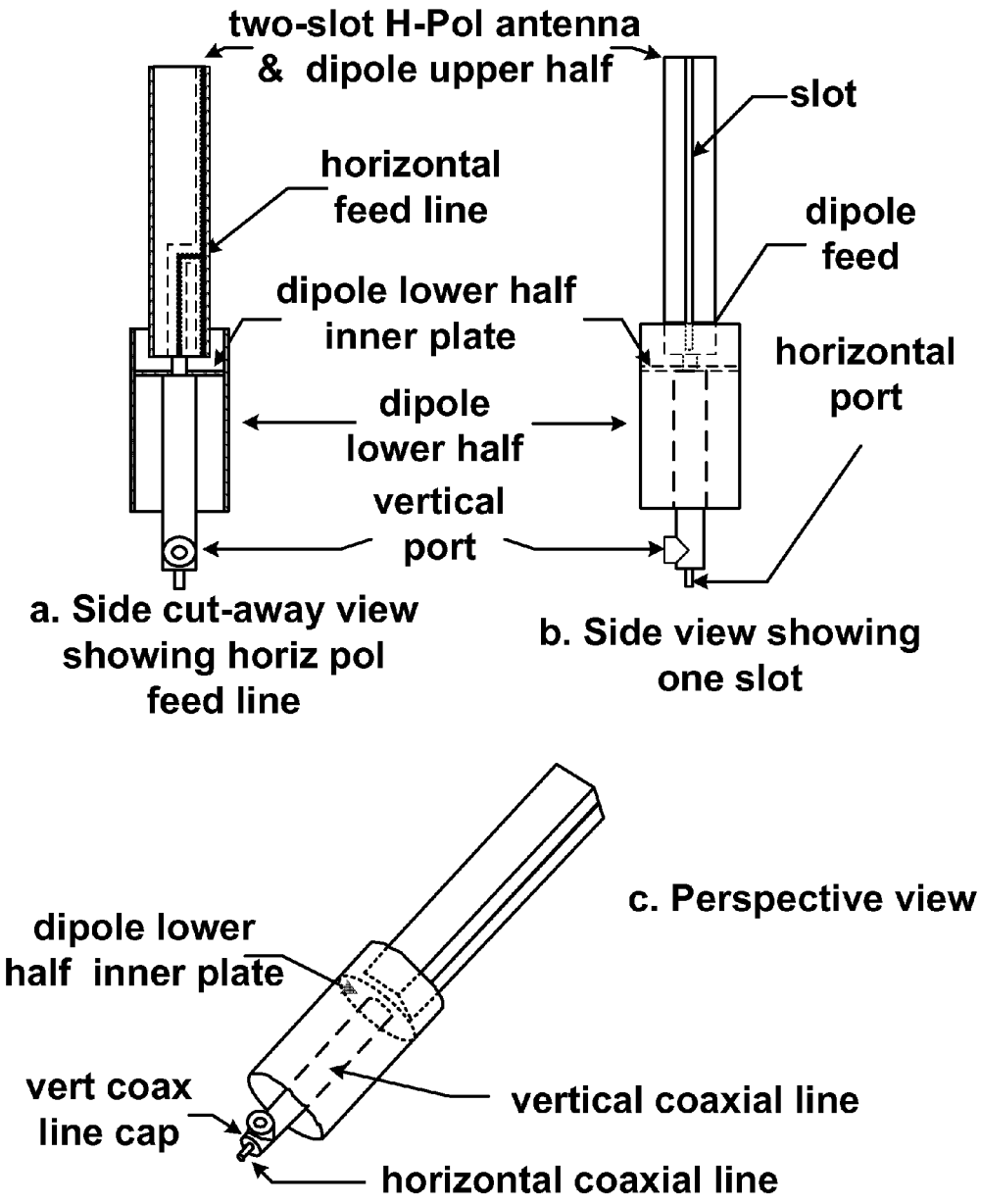
Figure 23. Common Aperture antenna

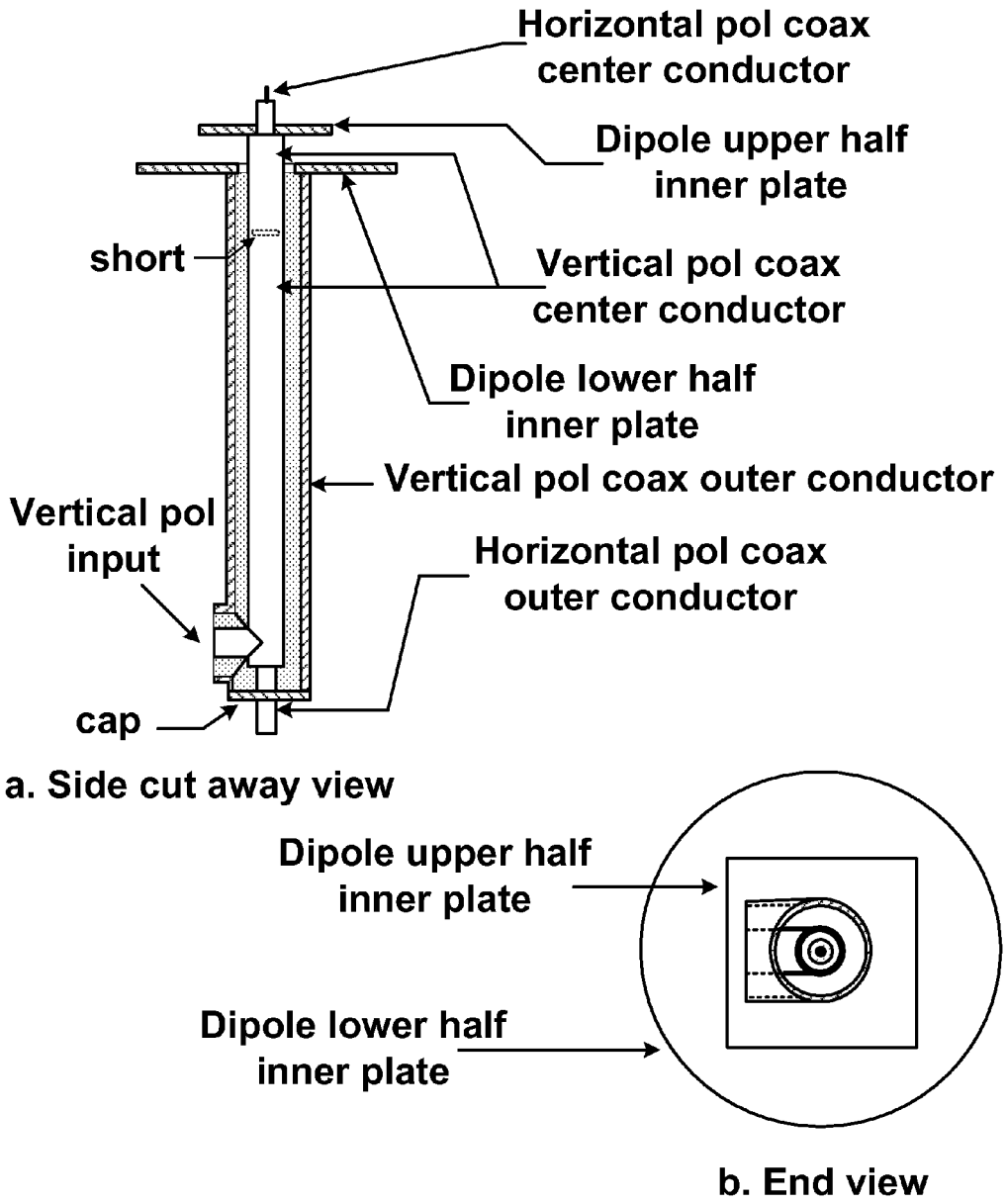
Figure 24. Duple-coax dual polarized antenna feed

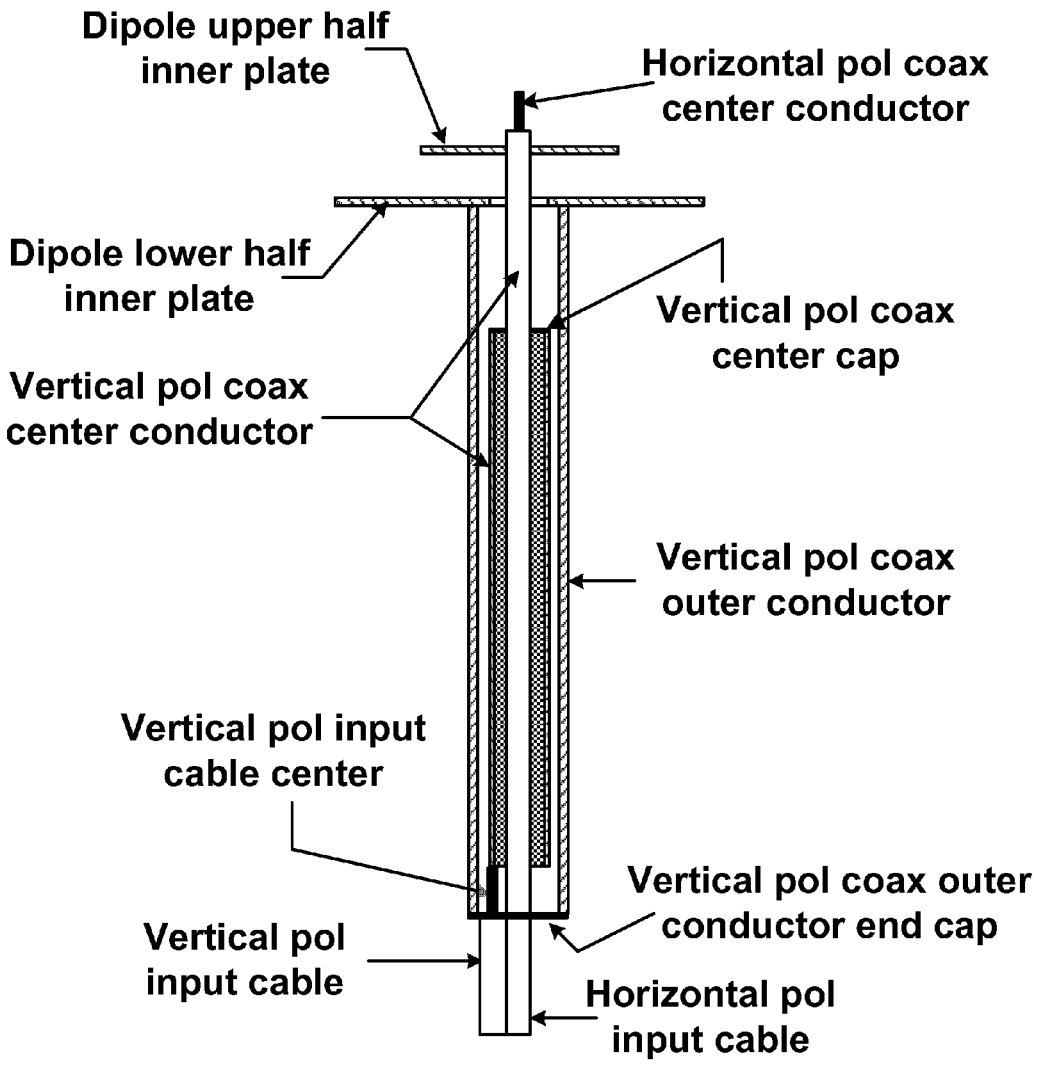
Figure 25. In-line duple-coax dual polarized antenna feed

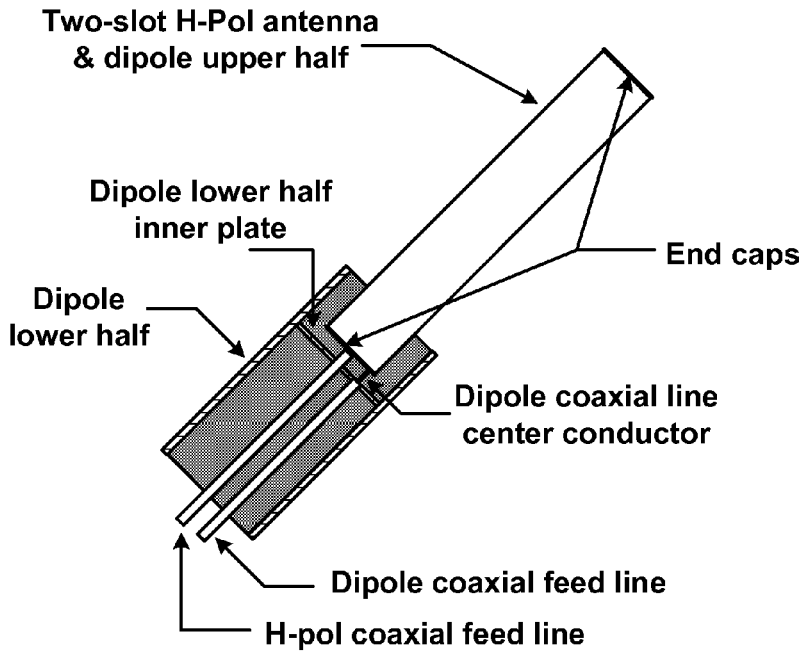
Figure 26. Common Aperture Antenna with two independent coaxial feeds

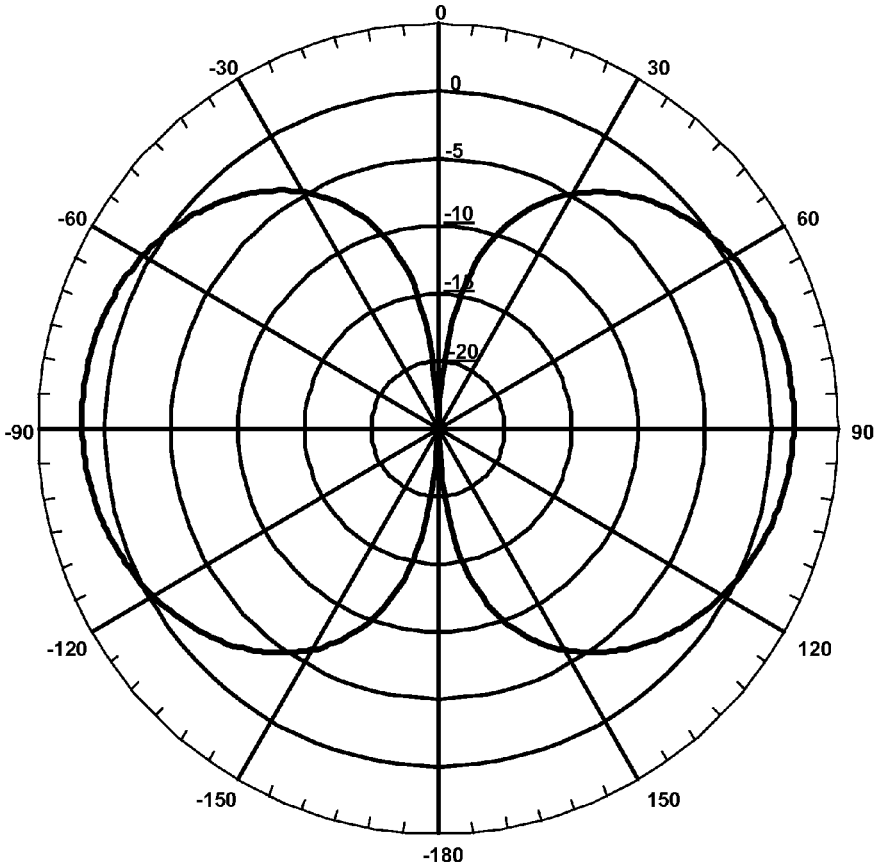
Figure 27. Common Aperture antenna elevation far field pattern – horizontal polarization

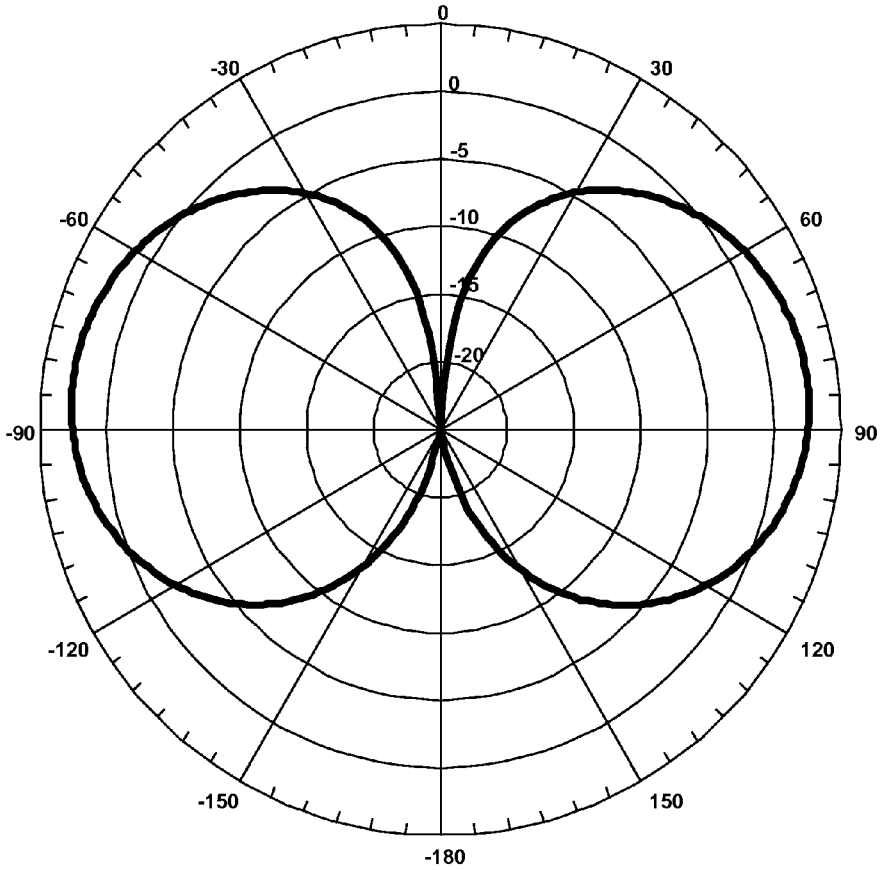
Figure 28. Common Aperture antenna elevation far field pattern – vertical polarization

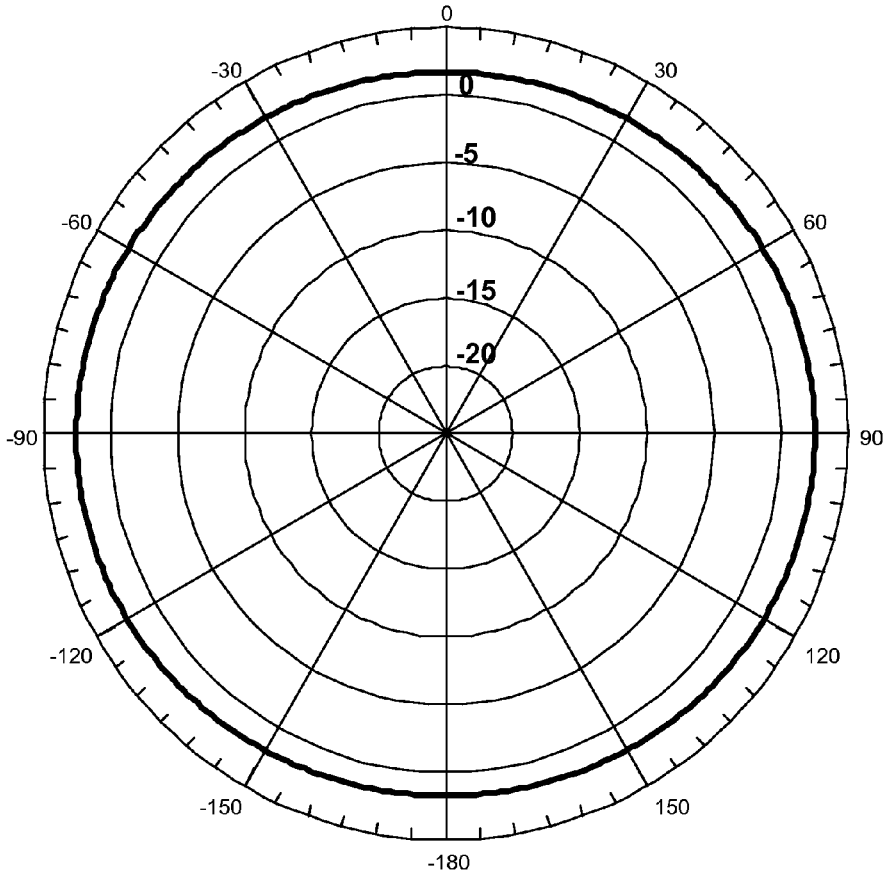
Figure 29. Common Aperture antenna azimuth far field pattern – horizontal polarization

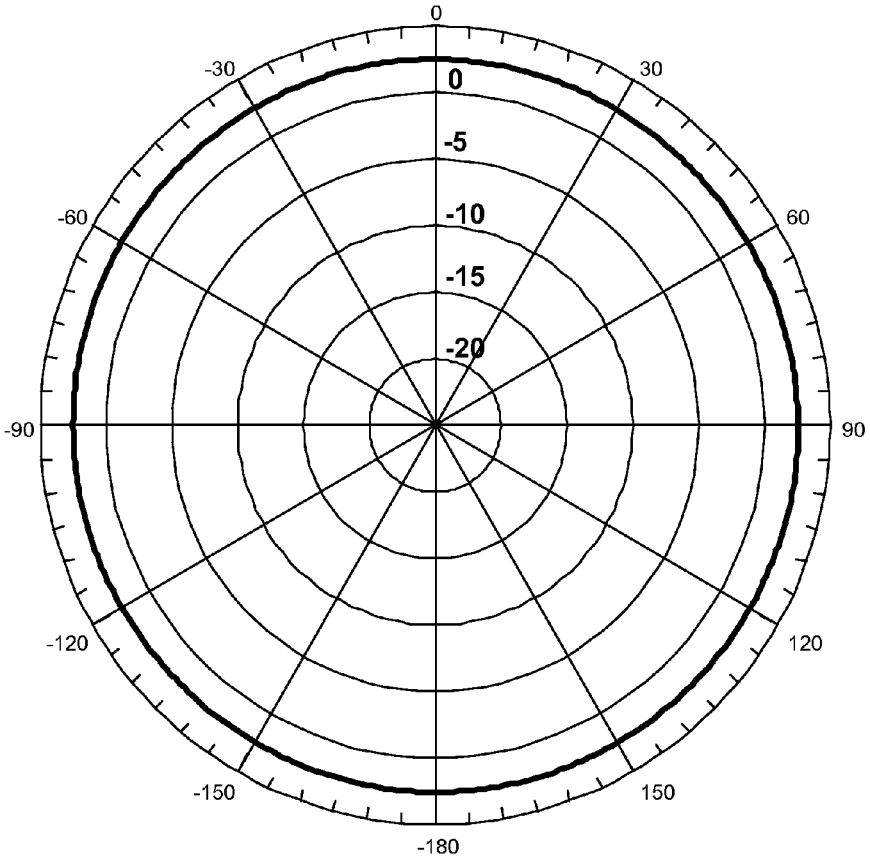
Figure 30. Common Aperture antenna azimuth far field pattern – vertical polarization

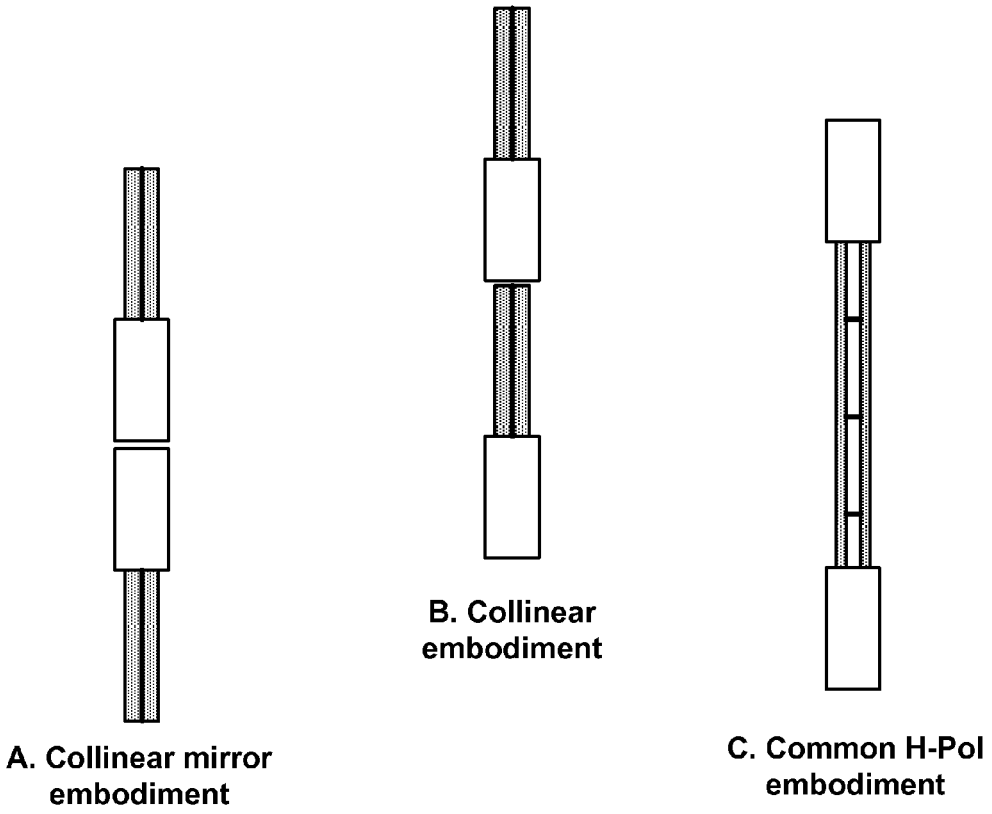
Figure 31. Two-element array embodiments of Common Aperture Dual Polarized Antennas

MULTI-SLOT COMMON APERTURE DUAL POLARIZED OMNI-DIRECTIONAL ANTENNA

REFERENCE TO RELATED APPLICATIONS

This patent application claims the benefit of U.S. Provisional Application Ser. No. 61/615,006, filed Mar. 23, 2012, the disclosure of which is incorporated by reference herein.

BACKGROUND

Wireless communication has become an integral part of modern life in personal and professional realms. It is used for voice, data, and other types of communication. Wireless communication is also used in military and emergency response applications. Communications that are made wirelessly rely on the electromagnetic spectrum as the carrier medium. Unfortunately, the electromagnetic spectrum is a limited resource.

Although the electromagnetic spectrum spans a wide range of frequencies, only certain frequency bands are applicable for certain uses due to their physical nature and/or due to governmental restrictions. Moreover, the use of the electromagnetic spectrum for wireless communications is so pervasive that many, if not most, frequency bands are already over-crowded. This crowding may cause interference between and among different wireless communication systems.

Such interference jeopardizes successful transmission and reception of wireless communications that are important to many different aspects of modern society. Wireless communication interference can necessitate retransmissions, cause the use of ever greater power outlays, or even completely prevent some wireless communications. Consequently, there is a need to wirelessly communicate with reduced electromagnetic interference that may hinder the successful communication of information.

SUMMARY

An antenna having a single aperture may introduce a significant disparity in the field strength and consequently a difference in the surface current density along the opposite surface from the aperture of the antenna. This results in a difference in the radiation intensity and, hence, a difference in the far field radiation pattern in the horizontal plane giving rise to maximum to minimum variance in the omni-directional (circular) pattern of 2.5 dB to 4 dB.

Example embodiments of antennas having a multi-slot aperture that reduce the variation in the far field omni-directional pattern are described herein.

While described individually, the foregoing embodiments are not mutually exclusive and any number of embodiments may be present in a given implementation. Moreover, other antennas, systems, apparatuses, methods, devices, arrangements, mechanisms, approaches, etc. are described herein.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items. The patent or application file contains at least one drawing executed in color. Copies of this patent or patent application publication with color drawing(s) will be provided by the Office upon request and payment of the necessary fee.

FIG. 1 illustrates an exemplary conducting tube having two slots.

FIG. 2 illustrates electric fields of an exemplary conducting tube having two slots.

FIGS. 3A and 3B illustrate an exemplary two-slot antenna construction with two rectangular U-channels affixed to a supporting structure utilizing Printed Circuit Board (PCB) techniques.

FIGS. 4A and 4B illustrate one of the U-channel halves and a PCB support structure of an exemplary antenna construction.

FIGS. 5A and 5B illustrate PCB approaches utilizing a modified microstrip line configuration used for a supporting structure.

FIGS. 6A and 6B illustrate a support structure approach utilizing a modified coplanar waveguide (CPW).

FIG. 7A illustrates a perspective view of an exemplary assembled antenna.

FIG. 7B illustrates a perspective view of a PCB support structure showing feed lines, a feed pin, a pin fastener, a short section of a coaxial cable and four location tabs.

FIG. 7C illustrates an end view of a two-slot antenna.

FIG. 8A illustrates a perspective view of an antenna.

FIG. 8B illustrates a perspective view of a square cross-section inner conductor showing feed pins and a coaxial cable.

FIG. 8C illustrates an end view showing relationships of feed pins to each other and to slots.

FIGS. 9A and 9B illustrate two exemplary four-slot (or quadru-slot) embodiments utilizing a circular and square, respectively, cross-sectional tube for the antenna body.

FIG. 10A illustrates a perspective view of a support structure with conducting strips.

FIG. 10B illustrates two components that make up a support structure separated to show axial slits cut into a laminate.

FIG. 10C illustrates a perspective view of a support structure without conducting strips.

FIG. 11 illustrates exemplary three-slot (or tri-slot) antenna embodiments utilizing a circular and triangular cross-sectional tube, respectively, for the antenna body.

FIGS. 12A and 12B illustrate a circular rod configuration and a thin plate configuration, respectively.

FIGS. 13A and 13B illustrate an input end view and a perspective view of feed plates without feed plate supports.

FIG. 14 illustrates angular coordinates for a 3-dimensional coordinate system.

FIG. 15 illustrates a multi-slot antenna elevation far field pattern.

FIG. 16 illustrates a multi-slot antenna azimuth far field pattern.

FIGS. 17A and 17B illustrate a perspective view and an end view of an example high gain two-slot antenna.

FIGS. 18A-18D illustrate a microstrip series feed support structure.

FIGS. 19A-19D illustrate a modified CPW support structure.

FIGS. 20A-20C illustrate an exemplary high gain antenna utilizing a four feed set configuration energized by a coaxial line.

FIG. 21 illustrates a simulated typical elevation far field radiation pattern for the high gain two-slot antenna.

FIG. 22 illustrates a simulated typical azimuth far field radiation pattern for the high gain two-slot antenna.

FIG. 23 illustrates an embodiment of a common aperture antenna utilizing a two-slot horizontal polarized λ/2 antenna and a uniquely configured dipole antenna.

FIG. 24 illustrates an embodiment of a duple-coaxial line construction.

FIG. 25 illustrates an in-line duple-coaxial line.

FIG. 26 illustrates a common aperture dual polarized antenna with a feed technique using two independent coaxial lines to feed two orthogonal polarized antennae.

FIG. 27 illustrates common aperture antenna far field elevation patterns for horizontal polarization.

FIG. 28 illustrates common aperture antenna far field elevation patterns for vertical polarization.

FIG. 29 illustrates common aperture antenna far field azimuth patterns for horizontal polarization.

FIG. 30 illustrates common aperture antenna far field azimuth patterns for vertical polarization.

FIG. 31 illustrates three embodiments of two common aperture dual polarized antennae collinearly arrayed.

DETAILED DESCRIPTION

Introduction

An antenna operated such that the electric field emanating from the antenna is parallel to a plane defined by the surface of the earth is said to be horizontally polarized. In example embodiments, this disclosure describes a horizontally polarized antenna that may be mounted or operated with the physical vertical axis of the antenna (e.g., a vertical longitudinal axis) being substantially perpendicular to a plane defined by the surface of the earth, and still emanate an electric field that is parallel to the surface of the earth. Use of horizontal polarization may improve communications reliability by reducing interference from predominantly vertically polarized signals in overlapping and adjacent frequency bands.

Compact horizontally polarized antennas have not proliferated in the marketplace. Most horizontally polarized antennas that have been developed and marketed are relatively large or are aesthetically obtrusive. Until recently, no slim horizontally polarized antenna having physical similarities to a vertical dipole has been commercially available. U.S. Pat. No. 7,948,440, issued on 24 May 2011, by inventors Royden M. Honda and Raymond R. Johnson, entitled "Horizontal Polarized Omni-Directional Antenna" describes an omni-directional horizontally polarized antenna. U.S. patent application Ser. No. 12/576,207, which has issued as U.S. Pat. No. 8,570,239, by inventors Royden M. Honda and Robert J. Conley entitled "Spiraling Surface Antenna" also describes an omni-directional polarized antenna. Both U.S. Pat. No. 7,948,440 and U.S. Pat. No. 8,570,239 are herein incorporated by reference in their entirety. The present application discloses various embodiments of a subsequently developed omni-directional antenna that has a number of additional features discussed below.

Electrical Considerations

Exemplary embodiments of a two-slot antenna having cross sections that may be substantially square, substantially rectangular or substantially circular are described herein. However, other cross sections, for example, substantially polygonal or substantially elliptical cross sections, may also be employed.

Although this disclosure discusses various embodiments of a two-slot tubular antenna, the concept may be extended into a multi-slot antenna, whereby alternate walls or every wall of a substantially polygonal structure may have a slot fashioned into it. As an example of a substantially elliptical tubular structure, the longitudinal axes of the slots may generally be parallel to the axis of the tube and spaced along the surface judiciously and excited appropriately to maintain correct relative amplitude and relative electrical phase and rotating electric field from one slot to an adjacent slot. This allows the resultant vector sum of the emanating electric field to produce a well-behaved far field generally circular (omnidirectional) pattern in the plane normal to the axis of the antenna.

Well-behaved, in the context of this disclosure, is defined to mean that the ripple (variation from crest to trough) in the generally circular pattern is less than or equal to 3 dB, with the trough angular spacing in the generally circular pattern occurring approximately 360°/n around the antenna axis, where n=the number of slots. As an example, a well-behaved far field generally circular (omni-directional) pattern in the plane normal to the axis of the antenna yields a maximum to minimum gain variation in omni-directionality of the antenna of less than or equal to 3 decibels (dB). The same relationship of the multiple slots in a substantially polygonal structure to electrical phasing as discussed previously is to be maintained. For example, in embodiments of antennas having a square, a rectangle or a circular cross section with four slots, each slot may be fashioned into opposite sides of the structure. From the end view of the cross section, the slots may be physically oriented 90° apart around the antenna axis. In this example, the relative electric field relationship of adjacent slots may be 90° to each other with increasing or decreasing electric field sum in the clockwise (CW) or counter clockwise (CCW) direction as observed from the end view of the structure. As an example, one slot may be selected as reference with a relative electric field of 0°, the adjacent slot in the CW direction may be a relative electric field of 90°, the next slot may be a relative electric field of 180°, and the fourth slot may be a relative electric field of 270°. Hence, the total electric field rotation when the clockwise circuit is traversed from the reference slot back to the reference slot may be 360°.

As an example, FIG. 9 illustrates two embodiments of a four-slot (quadru-slot) antenna configuration. Embodiments of a three-slot (tri-slot) antenna configuration are illustrated in FIG. 11.

FIG. 1 illustrates an exemplary conducting tube 100 configured to have two slots (slot A and slot B) fashioned into opposite walls of a square or rectangular conducting tube that requires two feeds. One feed may be at one of the slots (e.g., slot A) with another feed at the other slot (e.g., slot B). One feed may introduce a positive charge along an edge of slot A, and the other feed may introduce a negative charge along an edge of slot B, where both slot edges may be located on the same conducting tube half. Thus, in exemplary conducting tube 100, a surface current flow in one direction may be induced along the surface of the conducting tube half from one edge of slot A to an edge of slot B. The other edge of slots A and B may be negatively and positively charged, respectively. These slot edges may also induce current flow along their common conducting tube half. This surface current may flow in the same direction as the current induced on the previously described conducting surface. The continuous flow of the surface currents around the conducting tube is disrupted at the slots (i.e., Slot A and B). However, at a slot, a potential difference is created by the negative and positive charges introduced by the feed, producing electric fields across the slot. Exemplary conducting tube 100 is shown to have a slot length L that coincides with the axis (i.e., longitudinal axis) of conducting tube 100 and a slot width W, such that L>>W, as described in greater detail herein. Conducting tube 100 may be configured as part of an antenna having a longitudinal axis that is collinear with slot length L. As an example, when the longitudinal axis is substantially perpendicular to a plane defined by the surface of the earth, the longitudinal axis is considered collinear with a vertical longitudinal axis, and the antenna is configured to transceiver (e.g., receive and/or transmit) a horizontally polarized omni-directional signal.

FIG. 2 illustrates an exemplary environment 200 where electric fields are represented by vectors. In exemplary environment 200, an electric field vector may be associated with a first slot (e.g., Slot A of FIG. 1) denoted as E. The other feed may induce a potential difference equal to but 180° or opposing electric field direction to that of the first slot, generating E-field vectors opposite in direction to the electric field vectors of the first slot. If the vector of the first slot is E, then the second slot (e.g., Slot B of FIG. 1) vector is denoted as −E.

As an example, continuity of the surface current flow in the conducting surface is sustained at the slot by the electric fields across the slot. The generated electric field vectors do not exist within the conducting medium. The field vectors travels outward, away from the slot, while its end points maintain contact with the conducting surfaces until the tip of the arrow head of one set of vectors meets the tail end of the arrow of the other set of vectors. These vectors join together to form circular rings of closed vectors, which continues to emanate outward from the antenna forming the far field omni-directional pattern of the two-slot antenna, as illustrated in FIG. 2.

Mechanical and Electrical Considerations

The exemplary embodiments in the following discussion use specific cross sectional shapes in describing the antenna structure. However, as mentioned in the Electrical Considerations section above, the cross sectional shapes of the two-slot antenna are not necessarily confined to the specific shapes utilized in the following examples. Dimensions for the two-slot antenna using a substantially circular, substantially square or a substantially rectangular cross section are given in wavelength of the design frequency. The antenna is physically scalable from a given design frequency to other designated frequencies.

The antenna conducting surfaces may be fabricated from available conductive materials such as metal tubing, U-channels, rods or sheet metal. Alternate fabrication techniques may utilize molding, forming, and extrusion type process for metals, plastics, ceramics or other materials. When non-conductive materials are utilized, surfaces may be made to exhibit conductive properties through various techniques such as metal plating, infusion of conducting materials etc.

It is to be understood for the purposes of this disclosure that reference to wavelength (λ) implies a wavelength within a medium, the medium having a permittivity of 1.0 (free space) or greater or smaller as in the case of metamaterials including those with negative permittivity. For example, a permittivity greater than 1.0 alters the velocity of propagation of an electromagnetic wave within the mediumrelative to free space, resulting in a wavelength that is shorter in non-free space media. The expression for a wavelength within a medium is as follows:

$$\lambda=\lambda_o/(\in_r)^{1/2}$$

where:

$\lambda$=wavelength in the medium $\lambda_o$=free space wavelength $\in_r$=permittivity of the medium Generally, the diameter and diagonal is approximately 0.117λ for the cylindrical and the rectangular tube, respectively, and the structure height along the structure's longitudinal axis is approximately 0.54λ (e.g., $L_1$ of FIG. 8) to accommodate the slot which is substantially λ/2 (e.g., L of FIG. 1 or $L_2$ of FIG. 8) in height. The slot width (e.g., W of FIG. 1) may be approximately 0.002λ to approximately 0.026λ. The tubes may utilize conducting or non-conducting or combinations of both material types for end caps to seal the ends of the tubes.

Also it is to be understood for the purposes of this disclosure that reference to the terms "couple" or "coupling" are used in the following discussion to refer to energy transfer from one conductor to another conductor or from one wave guide to another wave guide, as including a physical connection or a nonphysical connection. A nonphysical connection may include inductive and/or capacitive methods.

Various embodiments are disclosed herein to facilitate the manufacture and assembly of the two-slot antenna. As an example, the antenna utilizes a supporting structure to hold two halves of either semi-circular troughs or rectangular or square U-channels. This design may use tubes described herein and extend the slot heights to a height of the tube and thus cut the tube into two identical halves. This approach may also have the ends open or closed with conducting or non-conducting or combinations of both types of materials for the end caps as in the tube designs described herein.

Example Antenna Embodiments

FIG. 3 illustrates an exemplary two-slot antenna construction 300 with two rectangular U-channels affixed to a supporting structure utilizing Printed Circuit Board (PCB) techniques. FIG. 3*a* illustrates the end view of the antenna with the corresponding PCB and end cap. FIG. 3*b* illustrates a perspective view of an assembled two-slot antenna showing the PCB, both end caps and a coaxial cable coupled to the PCB.

FIG. 4 illustrates an example construction 400. FIG. 4*a* illustrates one of the U-channel halves and FIG. 4*b* illustrates a PCB support structure. The supporting structure may utilize printed circuit construction of stripline, microstrip lines or modified coplanar wave guide to energize the antenna. Other transmission lines such as coaxial cables, or coaxial cables and printed circuit combinations are alternative or additional approaches that can be utilized as an integral part of the supporting structure. However, in an embodiment, to achieve the 180° electric field direction relationship between the electric fields at the two slots, additional devices, for example 180° hybrid or additional line length in one of the feed lines is required. The PCB configuration utilized in the illustrated embodiment may not require additional devices.

FIG. 5 illustrates one example of the PCB approaches utilizing a modified microstrip line configuration (i.e., for the support structure shown in FIG. 4*b*). FIG. 5*a* shows the conductive traces on one side of a substrate. The ground shown is for the microstrip trace located on the opposite side of the substrate. FIG. 5*a* also shows an attachment strip (e.g., for attachment to U-channel of FIG. 4*a*), a micro-strip line, tuning stub and coaxial cable feed. The traces seen in FIG. 5*a* have a mirror image on the other side of the substrate as shown in FIG. 5*b*. The stub lines may be used as tuning stubs for impedance matching. The attachment strip is part of the feeding system in conjunction with the microstrip line. The microstrip lines may be fed in phase and equal amplitude at the input by a unique method using parallel pairs of conductive lines on either side of the substrate. This method eliminates a power-dividing network that otherwise require additional space. The power division is accomplished by affixing the center conductor of the coaxial line to both of the parallel lines at the notch cut-out as detailed, for example, in FIG. 6*b*.

Although the lines are initially fed in phase, the vectors of the microstrip E-field and their relationship to their respective ground traces have opposite directions. At the terminal of the lines, which are the slot edges, electric fields that satisfy the 180° phase criterion between the two slots are created.

FIG. 6 illustrates another support structure approach utilizing a modified coplanar waveguide (CPW). The performance may be very similar to that of the modified microstrip configuration. Like the microstrip approach described above, the power division may be accomplished via the unique parallel line approach. In one example of the modified CPW design, the parallel lines continue as a pair of parallel CPWs and make a right angle bend at the location of the feed. One bend directs energy to one slot and the other bend directs energy to the second slot. FIG. 6*a* illustrates the bends with one bend on the side facing the viewer. The other bend is seen through the substrate (i.e., CPW feed line on opposite side of substrate) as indicated in FIG. 6*a*. Both lines may be fed in phase and with equal amplitude, but the lines connect to the respective slot edges that are opposites so that the fields induced between the slots are electrically 180° in phase relationship. Corresponding grounds are shown isolated from the CPW feed lines by the substrate. FIG. 6*b* is a perspective view showing the method by which the power division may be accomplished. The connector has been removed in this view and the cutout for the connector cable center conductor is visible. The parallel identical CPW feed lines can also be seen. The center conductor may be placed in the cutout and affixed to both parallel CPW lines, and thus equal power division is accomplished and both lines are independent with their own grounds.

The far field elevation and azimuth patterns generated by this method may be identical to that of the modified microstrip PCB support structure of FIG. 5. FIGS. 15 and 16, respectively, show the typical elevation and azimuth far field patterns. As shown in FIG. 16, the azimuth far field pattern is a well-behaved far field generally circular (omni-directional) pattern in the plane normal to the axis of the antenna that yields a maximum to minimum gain variation in omni-directionality of substantially less than 3 dB.

In one example regarding the PCB support structure described herein (e.g., FIGS. 5 and 6), the laminate may include a single non-conductive substrate with conductive material on both sides of the board. The conductive tube halves may be affixed to the support structure, and the width of the slot is therefore determined by the thickness of the PCB. A PCB is used because of its rigidity in addition to the close tolerances that can be held in the dimensions of the feed lines. The U-channels illustrated in FIG. 3 may be affixed to the PCB along the attachment strips and the grounds on both sides of the PCB. The support structure and the affixed U-channels combine to make the two-slot antenna mechanically sturdy. The open ends of the structure may be sealed with conductive and/or non-conducting end caps or left open.

Therefore, FIGS. 1-6 represent examples of antennas, where an antenna comprises a tube that has an internal surface and an external surface, where the tube forms an internal cavity having slots extending from the internal surface to the external surface along a longitudinal axis of the antenna, a supporting structure disposed at least partly within the internal cavity of the tube, where the supporting structure has at least a first face and a second face and an electrically conductive transmission line and an electrically conducting ground disposed on the first face and the second face of the supporting structure, where the transmission line and the ground are electrically coupled to the slots. As discussed above, a height of the slots (e.g., L of FIG. 1) may be set responsive to a wavelength of a wireless signal being transceived (e.g., transmitted and/or received) by the antenna. As shown in example FIG. 3*b*, the supporting structure may protrude at least partly into the slots of the tube and the transmission line and the ground may be positioned sufficiently proximate to the slots of the tube. The transmission line and the ground may be electrically coupled to the slots via at least one of a feed pin, a soldering contact, an inductive coupling or a capacitive coupling. The antenna may be operated in a vertical orientation where the longitudinal axis of the antenna is perpendicular to a plane defined by the surface of the earth. In this vertical orientation, the antenna is configured to transceive a horizontally polarized substantially omni-directional wireless signal that is perpendicular to the vertical longitudinal axis of the antenna. As such, the antenna may have the appearance of a vertical dipole antenna in a vertical orientation, yet transceive a horizontally polarized substantially omni-directional wireless signal that is parallel to a plane defined by the surface of the earth.

Another embodiment of a U-channel two-slot antenna incorporating a PCB support structure is shown in FIG. 7. FIG. 7*a* is a perspective view of the assembled antenna. FIG. 7*b* is a perspective view of the PCB support structure showing feed lines, a feed pin, a pin fastener, a short section of a coaxial cable and four location tabs. FIG. 7*c* is an end view of the two-slot antenna. The feed line may be fashioned as a conductive line. There are two lines, one on each side of the substrate, that may be 180° rotational images about the longitudinal axis of the support structure. The feed pin may be any devices such as screws, standoffs, threaded rods or a rod of any cross-sectional shape including substantially circular, elliptical or polygonal, or the like. The feed pin may be fashioned as part of the U-channel construction using sheet metal forming techniques, molding, etc. Generally, the material used to construct the feed pin should be able to transfer energy from the feed line to an edge of a slot to induce an electric field across the opening of the slot. The fastener may be any device or attachment method that will hold the feed pin in place and in good electrical coupling with the feed line. The fastener is not a required part if the feed pin is affixed directly to the feed line by bonding means. The location tabs are shown as an example of part registration methods, however many mechanical techniques may be employed. The substrate butted against the inside surfaces of both U-channel bases keep the ends of the channel sides from touching and thus form the slot width. The location tabs are attached to the base by bonding means. The feed pins may be attached to the U-channel side by mechanical means such as screws or fasteners and also by bonding means. End caps, affixed at one or both ends, may be used to further strengthen and maintain dimensional stability. These end caps may be fabricated from conducting and/or non-conducting materials. Both ends may be capped either with the same type material or one end with conducting and the other with non-conducting caps.

FIG. 8 is yet another embodiment of a two-slot antenna. In this embodiment, the slots are fashioned into opposite walls of a square tube. FIG. 8*a* is a perspective view of the antenna, where the square tube has a length of $L_1$ and the slot has a length of $L_2$ along the longitudinal axis of the square tube. The inner conductor may be configured to extend just part way into the internal cavity of the tube. As an example, the inner conductor comprises a supporting structure disposed at least partly within the internal cavity of the tube. FIG. 8*b* is a perspective view of the square cross-section inner conductor showing the feed pins and the coaxial cable. FIG. 8*c* is an end view showing the relationships of the feed pins to each other and the slots. In this embodiment, the inner conductor and the tube form a square coaxial line. The inner conductor is an extension of the coaxial cable center conductor. A conducting end cap (not shown in FIG. 8) is attached to the tube. A hole is fashioned in the end cap to accommodate and support the coaxial feed cable and maintain the electrical potential of the outer conductor of the cable and the tube in relation to their respective inner conductors. The feed pins, as mentioned in the previous paragraph, may be commonly available hardware or fashioned as features of the tube or supporting structure. For example, a clearance hole may be fashioned in close proximity to one side of the slot and generally about the tube mid-section to accommodate a screw. The inner conductor may have a tapped hole whereby a threaded fastener can be passed through the hole from outside the tube and threaded into the tapped hole. This screw functions as the feed pin and also as a support for the inner conductor.

FIG. 9 illustrates exemplary four-slot (or quadru-slot) embodiments utilizing a circular and square cross-sectional tube for the antenna body. As shown in the example embodiments, a support structure may protrude through a slot in four places, such as through each of the four slots of the circular cross-sectional tube antenna shown in FIG. 9*a*, and the rectangular cross-sectional tube antenna shown in FIG. 9*b*. FIG. 10 illustrates a support structure utilizing conductive clad laminates. FIG. 10*a* shows a perspective view of an assembled support structure that may be used for an exemplary four-slot (or quadru-slot) antenna, such as shown in FIG. 9. The assembled support structure is shown with conductive strips, feeds (e.g., to feed corresponding slots of antennas of FIG. 9) and nonconductor sections, such as a PCB substrate. FIG. 10*b* shows two components that make up the support structure separated to show the axial slits cut into the laminate. The axial slits are for clearance so that the two parts can be mated together, whereby each of the laminate ends may be flush and form the support structure as shown in FIGS. 10*a* and 10*c*. In an embodiment, FIGS. 10*a* and 10*c* may be identical support structures except for the optional conductive strip shown in FIG. 10*a*.

FIG. 11 illustrates exemplary three-slot (or tri-slot) embodiments utilizing a circular and triangular cross-sectional tube for the antenna body. FIG. 11*a* illustrates an exemplary three-slot (or tri-slot) embodiment utilizing a triangular cross-sectional tube for the antenna body showing an end view with three slot feeds and a perspective view showing slots and a feed cable. FIG. 11*b* illustrates an exemplary three-slot (or tri-slot) embodiment utilizing a circular cross-sectional tube for the antenna body showing an end view with three slot feeds and a perspective view showing slots and a feed cable. In these embodiments, the feed cable may act as an inner conductor that extends only part way into the internal cavity of the tubes illustrated in FIGS. 11*a* and 11*b*. In these embodiments, the inner conductor and the tube may be configured to form a coaxial line, such that the inner conductor is an extension of a coax cable or feed line center conductor. The inner conductor may include feed slots that are electrically coupled to corresponding slots of their associated tube.

FIG. 12 illustrates exemplary feed embodiments utilizing a circular rod configuration with feed vanes in FIG. 12*a* and conductive L-shaped plates attached to an optional tapered circular plate support in thin plate configuration FIG. 12*b*. The rod shown in FIG. 12*a* may be a tubular rod, be of any cross-sectional shape, or the like. The rod may form the center conductor (e.g., inner conductor) of a coaxial line. The outer conductor may be formed by the tube. The number of vanes, on the rod, may range from one as in the case of a single-slot embodiment or more as in the case of the two-slot (FIG. 8), three-slot, four-slot embodiments, etc. The feed plates shown in FIG. 12*b* may be brought together at the input end so that the optional feed plates support may be eliminated.

FIG. 13 illustrates an embodiment of the feed plates without the feed plate support. FIG. 13*a* is an input end view of the feed plates illustrating the feed plates making direct contact to each other at the input to the plates. FIG. 13 shows a beveled edge at the short end of the feed plate. Contact between the end plates may not be necessary if other non-direct contact energy coupling means are utilized. The feed plates may have a non-conductive support placed between the plates to enhance alignment and structural rigidity. The feed embodiments may be fashioned from conductive materials, conductive clad laminates or a combination of both laminate and conductive materials.

An antenna array may be constructed by stacking a number of collinearly aligned multi-slot constituent antennas (each constituent antenna being a complete antenna), thus forming a column. Each of the constituent antennas may have a transmission feed line associated with the constituent antenna. A feed point associated with each antenna feed line may be spaced along the length of the column in such a way as to establish a desired phase relationship between each of the individual constituent antennas in the column.

Forming a column of antennas may increase the effective aperture of the column with each antenna added. As the effective aperture of an antenna increases so does the gain of the antenna. For example, doubling the number of antennas in the array increases the gain by 3 dB.

Alternatively, rows containing columns of one or more multi-slot antennas may be fashioned into an array by replicating the column of constituent antennas into multiple columns of constituent antennas. An array configured in this manner may be a planar array, or may be circular, elliptical, polygonal, or an array contoured to fit the shape of a structural surface. A desired phase relationship for each constituent antenna in such an array may be determined by design, taking into account the intended application of the antenna array. For example, such an array may be configured so that it produces high antenna gain in the direction of low power utility meters and simultaneously produces low antenna gain in the direction of interfering sources, such as cellular telephony networks or Internet service providers. Therefore, an antenna array may be constructed that comprises a plurality of antennas such that locations of the feeds may be selected to maintain uniform electric field phase relationships across the plurality of antennas.

A multi-slot antenna may be designed to be relatively "slim." That is, it may have physical similarities to a vertical dipole, but be a horizontally polarized omni-directional antenna. With the antenna oriented as a vertical dipole, the longitudinal axis of the antenna (i.e., the axis collinear with the longest length or greatest height of the antenna) is oriented substantially perpendicular to a plane defined by the surface of the earth, and is defined as the vertical longitudinal axis of the antenna. In a further embodiment, a multi-slot antenna may also include a radome that either partially or completely surrounds the antenna. In an alternate embodiment, the radome may also partially or completely surround any supporting structure included with the antenna. A radome is added to protect the antenna from damage or to provide an impedance match between the antenna and the propagation medium. A radome may be a "structural" radome if it is intended to resist damage in outdoor applications. For example, the radome may be constructed to survive mechanical loading experienced in high wind conditions or may be made of materials to resist corrosive atmospheres. Indoor environments may only require a simple non-structural coating on the antenna to resist snags and to provide a pleasing aesthetic form. In one example, a coating or similar covering on the antenna may be a "non-structural" radome. In one embodiment, the radome is adapted to connect directly to an elevating member or a mounting structure for attachment purposes.

In an exemplary embodiment, the radome may have a cross-sectional shape configured to surround the antenna (and may also be configured, to surround a supporting structure). The cross-sectional shape of the radome may be a substantially circular shape or a substantially elliptical shape or a substantially rectangular shape. The cross-sectional shape of the radome may also be constructed using combinations of the above shapes.

Note that a polygonal shape may be approximated by one or a combination of a substantially circular shape or a substantially elliptical shape or a substantially rectangular shape. Further, since the antenna is slim, a defining smallest dimension of the cross-sectional shape (i.e., the diameter of a circle or minor axis of an ellipse or the shortest dimension of a rectangle) of a structural radome may be less than 0.2λ, or 0.2 times the wavelength of the center frequency of the antenna. Further, since the antenna is slim, a defining smallest dimension of the cross-sectional shape (i.e. the diameter of a circle, minor axis of an ellipse, or the shortest dimension of a rectangle) of a non-structural radome may be less than 0.12λ or 0.12 times the wavelength of the center frequency of the antenna.

The previous discussion of the two-slot antenna design was focused on a substantially λ/2 antenna height. The height of the two-slot antenna may be extended beyond the λ/2 height. The following discussion will be on an extension of the two-slot antenna with an exemplary extended height of approximately 2λ. This is four times the λ/2 height and is a 6 dB increase in gain over a single λ/2 antenna. In the following discussion, the antenna will be referred to as a high gain two-slot antenna. The construction of this antenna may also utilize a support structure in conjunction with slots cut into tubes or with U-channels as previously discussed. The excitation of the slot may use one or more feed-sets. In the following exemplary discussion a three feed-set system is utilized in a U-channel construction.

FIG. 17 illustrates an example embodiment of a high gain two-slot antenna. FIG. 17*a* is a perspective view of the antenna assembly and FIG. 17*b* shows an end view of the assembly. As an example, the support structure is a PCB with either a microstrip series feed approach or a CPW series feed. Both of these methods utilize the unique parallel line with the notched cut out concept to achieve equal phase and amplitude splits in both of the lines that excite the two slots as was described above in the λ/2 antenna discussion (e.g., with respect to FIG. 6).

FIG. 18 illustrates the microstrip series feed support structure. FIG. 18*a* illustrates a three section support structure. The two vertical lines divide the support structure into three sections numbered 1 through 3. FIGS. 18*b*, 18*c*, and 18*d* are enlarged to show details of the input (1), mid (2), and the end (3) sections, respectively. In one example, the microstrip lines (i.e., microstrips) at the input are parallel for approximately 0.2λ, then diverge to form separate microstrip feed lines on either side of the substrate. The grounds for the microstrip lines are on opposite sides of the substrate of the respective lines. In this and following discussions of the high gain antenna, the feeds that are in the same axial location and exciting the opposite slots will be referred to as feed-sets. As an example, the feed-sets (i.e., feed-set 1, feed-set 2 and feed-set 3) that excite the slots are spaced one λ apart (in electrical phase) within the microstrip line so that the feeds will be in phase and the aperture will be approximately illuminated uniformly.

FIG. 19 illustrates the modified CPW support structure. As one example, FIG. 19*a* illustrates a support structure divided into three sections separated by two vertical lines labeled as sections 1, 2 and 3. FIGS. 19*b*, 19*c*, and 19*d* are enlarged views showing details of the input (1), mid (2), and the end (3) sections, respectively. In contrast to the microstrip series feed line the CPW main trunk lines remain parallel and the feeds diverge away from the trunk line in opposite directions to excite the two slots at specified feed points along the antenna height. The feeds, from one of the trunk line parallel pair, may all come off of the line and head in the same outward direction exciting a slot at the predetermined feed points. The feeds from the other trunk line may come off the line at the same locations as the previous feeds but head in the opposite direction to excite the other slot in the two-slot antenna. Therefore, a gain of the antenna may be increased by increasing a length of the antenna. The transmission line and the ground of a microstrip line or CPW support structure may be electrically coupled to the slots using feed sets such that locations of the feed sets may be selected that maintain uniform electric field phase relationships along the increased length of the antenna.

Another exemplary high gain antenna is shown in FIG. 20 utilizing a four feed-set configuration energized by a coaxial line. FIG. 20*a* illustrates an antenna assembly (end caps not shown). FIG. 20*b* illustrates a perspective view of the inner conductor and the alternating feed-pairs for obtaining proper phase relationships of the induced electric fields at the slot. FIG. 20*c* illustrates an end view showing the relationship of the tube, inner conductor, feeds and slots. The feed pins appear to be four in the same plane but are actually four feed-sets superimposed so they only appear to be in the same plane. Feed-set 1 and feed-set 3 have feed pins in the upper left and lower right quadrants, whereas feed-set 2 and feed-set 4 have feed pins in the upper right and lower left quadrants. The feeds in the upper left and upper right quadrants are in, respectively, 180° phase relationship. However, the axial spacing between the feed-sets are λ/2 and, hence, have an additional 180° relative phase differential. Therefore, the induced electric field across the upper slot will be in phase along the length of the slot. This condition may apply to all of the previous high gain embodiments. The vector sum of the field is denoted as E. The feed pins in the lower left and lower right quadrants may undergo the same phase transformation. The sum of the induced electric field in the slot is opposite to that of the previous one and can be denoted as −E. Therefore, a gain of the antenna may be increased by increasing a length of the antenna, and locations of the feeds may be selected to maintain uniform electric field phase relationships along the increased length of the antenna.

In the previous paragraphs describing the high gain multi-slot antenna, the feeds were positioned along the slots so that the electric fields induced at a slot were in phase. The resulting electromagnetic plane wave emanating away from the antenna generated a broadside far field pattern. Broadside in this discussion connotes a radiation pattern having beam peak (or in relation to a plane, a direction vector of the plane wave) in the plane normal to the axis of the antenna (e.g., the axis along the length of the tube that includes feed-sets 1-4). The direction vector may be a vector normal to a plane. The vector is referenced to the origin of a 3-dimensional coordinate system illustrated in FIG. 14. Hence, with the antenna axis collinear to the z-axis and oriented perpendicular to the earth, the broadside beam peak or the direction vector of the plane wave will lie in the horizontal plane (elevation angle=0° or θ=90° in FIG. 14). However, the feeds may be spaced along the axial length of the antenna so that their relative phases are such that the direction vector of the wave front may be at an elevation angle above or below that of broadside. This scan angle can be up to ±15° about broadside without significant pattern degradation. The scan angle may be accomplished by fixed feed locations for a fixed scan angle or by electrical and/or mechanical means for beam scanning FIG. 23 illustrates an embodiment of a common aperture dual polarized (CADP) antenna utilizing a two-slot horizontal polarized λ/2 antenna and a uniquely configured dipole antenna. FIG. 23*a* illustrates the CADP antenna positioned vertically along a vertical longitudinal axis of the CADP antenna. As an example, the dipole upper half or the first part is the two-slot antenna and the lower half of the dipole or the second part is larger in cross-section (e.g., a cross-sectional area or cross-sectional dimension) than the first part and surrounds a portion of the first part. This asymmetry reduces the upward tilt of the vertical polarization far field elevation pattern and aligns it with the horizontal far field elevation pattern. As an example, upward tilt denotes that the direction vector of the vertically polarized plane wave emanating from the antenna is in a direction θ<90°, as discussed herein. The embodiment shown is with a cylindrical second part (e.g., a tube) approximately λ/2 in length. Both the second and the first antenna parts may also be square or have a generally polygonal, circular or elliptical cross-section. The first part may also have a minimum of one slot or multiple slots concomitant with the number of flat surfaces associated with a polygonal cross-section, and applies as well with a single or multi-slot circular or elliptical cross-sectional tube. FIG. 23*a* illustrates a side view of the CADP antenna showing a horizontal polarization feed line in the two-slot horizontal polarized first antenna part which is fed by the horizontal port (shown in FIG. 23*b*), and a vertical port for feeding the upper dipole half. FIG. 23*b* is a side view of the CADP antenna showing a slot in the first antenna part, a dipole feed and the horizontal port. FIG. 23*c* is a perspective view of the CADP antenna showing the dipole lower half inner plate, the vertical coax line, the horizontal coax line and the vertical coax line cap. As an example, the CADP antenna illustrated in FIG. 23 may comprise a first antenna part aligned with a second antenna part along a vertical longitudinal axis of the antenna, wherein the first antenna part may comprise a multi-slot antenna that emanates a horizontally polarized substantially omni-directional electric field perpendicular to the vertical longitudinal axis of the antenna, where a height of the first antenna part is based on a wavelength of a wireless signal being transceived by the first antenna part. The second antenna part may partially overlap the first antenna part and may comprise a tube coaxial with the first antenna part. A dipole may be formed by the first antenna part and second antenna part that emanates a vertically polarized electric field that is parallel to the vertical longitudinal axis of the CADP antenna. In this example, the second antenna part may be a lower part (e.g., lower half) of the dipole, and may not constitute an independent antenna. In contrast, the first antenna part may constitute an independent antenna. Additionally, the first antenna part may also be a part of a vertical polarized antenna since the first antenna part may be an upper part of the dipole. In this manner, the CADP antenna illustrated in FIG. 23 may be configured such that the upper half (e.g., first antenna part) of the dipole is an active drive portion of the CADP antenna, and the second antenna part may act to help establish the vertical electric field of the CADP antenna. As such, the second antenna part may not operate as a stand-alone antenna.

FIG. 24 illustrates an embodiment of a duple-coaxial line construction that fits inside the second antenna part and connects to the first antenna part of the CADP antenna of FIG. 23. This configuration simplifies the feeding of the individual antenna components of the common aperture dual polarized antenna and maintains the isolation between the two coaxial feed lines. As shown in FIG. 24*a*, the input to the vertical pol (i.e., polarization) coaxial line may be normal (e.g., at a right angle) to the axis of the vertical pol coaxial input line. The vertical pol coax center conductor may be a hollow tube to allow the horizontal pol coax to pass through without making contact with the inside surface of the vertical pol coax center conductor tube, as shown in FIG. 24*b*. Dielectric rings or sleeves (not shown) judiciously placed around the horizontal pol coax may be used to ensure both surfaces are kept apart. As shown in FIG. 24*a*, the vertical pol coax center conductor does not contact the conducting cap at the input end of the vertical pol coax outer conductor, but extends from the input end and terminates at the first part dipole upper half inner plate. This junction is the feed for the first antenna part dipole section of the common aperture dual polarized antenna, and the first antenna part may be connected to, and/or supported by, the dipole upper half inner plate. The conducting cap may be attached to both the vertical and horizontal coax to prevent leakage of energy from inside the vertical pol coax line, and it may also support the horizontal pol coaxial line, which comprises the horizontal pol coax outer conductor and the horizontal pol center conductor. At the vertical pol input, some energy may be coupled to the horizontal pol coaxial line fashioned by the inside surface of the hollow tube (i.e., vertical pol coax center conductor) and the horizontal pol coax outer conductor. To prevent this energy from interfering with the primary energy transmission through the CADP antenna, FIG. 24*a* illustrates a short that is placed within a space between the inside surface of the vertical pol coax center conductor and the outer surface conductor of the horizontal pol coaxial line. This short can be a ring or a sleeve of conducting material. The dipole lower half inner plate, as illustrated in FIGS. 24*a* and 24*b*, may be used to connect and/or support the dipole lower half (i.e., the second antenna part) of FIG. 23.

FIG. 25 is another embodiment illustrating an in-line duple-coaxial line. In this illustration, the vertical pol coax outer conductor is shown as a wire frame. In illustrated embodiments, the two coaxial lines (i.e., the horizontal pol input cable and the vertical pol input cable) are electrically independent and are electrically isolated from each other. The antennae feeds may be at different locations and are also isolated electrically from one another by conducting surfaces. As such, the vertical pol coax center conductor is electrically isolated from the horizontal pol coax center conductor. The vertical pol coax center conductor connects to the horizontal pol coax outer conductor at the vertical pol coax center cap. As an example, the vertical pol coax center cap may short the vertical pol coax center conductor to the horizontal pol coax outer conductor such that the horizontal pol coax outer conductor and the vertical pol coax center conductor become a same conductor above the vertical pol coax center cap. The cross-polarization induced by the far field radiation pattern of either antenna is less than −27 dB, relative to their co-polarization (principal polarization). With these characteristics, the common aperture dual polarized antenna will have excellent polarization discrimination. An application that would be well suited for this antenna is accurate determination of the polarization of an incoming signal.

FIG. 26 illustrates a common aperture dual polarized antenna with a different feed technique utilizing two independent coaxial lines, with one denoted as the H-pol coaxial feed line and the other denoted as the V-Pol coaxial feed line, to feed the two orthogonal polarized antennae (e.g., the two-slot H-pol antenna and the dipole upper half and dipole lower half). The upper dipole half (e.g., the two-slot H-Pol antenna), may be fed by the center conductor of the dipole feed cable (e.g., the V-Pol coaxial feed line). The center conductor may terminate at and may be affixed to an end cap. The outer conductor may terminate at and may be affixed to a dipole lower half inner plate. The H-Pol coaxial feed line outer shield may terminate and may be affixed to an end cap. The center conductor may go through a clearance hole in an end cap and may be affixed to the feed lines of the two-slot antenna support structure. As an example, the cross-polarization induced by the far field radiation pattern of the antenna illustrated in FIG. 26 is about −20 dB.

Infinite polarization variations, including linear and elliptical, may be achieved by varying the amplitude and/or phase of the energy into either the vertical polarization input or the horizontal polarization input or into both inputs.

The common aperture dual polarization antenna may be arrayed similarly as the two slot antenna discussed previously. FIG. 31 illustrates three embodiments of two common aperture dual polarized antennae collinearly arrayed. A fourth embodiment, not shown, is with a common circular lower dipole section similar to FIG. 31*a* (without the separation between the lower dipole sections). Each of these embodiments may be fed with four independent coaxial feed cables. One feed cable to each of the vertical and horizontal polarized antennae. Fed in this manner, phase and amplitude to the antennae may be varied to achieve polarization vector orientation adaptability, radiation pattern shape control and elevation beam peak pointing angle diversity. Alternatively, two external feed cables with appropriate power divider and phase shifter, located internally in the array, may be utilized to obtain an omni-directional fixed beam dual polarized medium gain antenna. To accomplish the adaptability of the four feed cable approach with two feed cables, amplitude distribution means and phase shifting means with switching means must be employed internally in the array. This would add complexity in the manufacturing process.

As an example, an array of CADP antennae for wireless electromagnetic communications may comprise at least two CADP antennae disposed in a linear, a collinear, a planar or a conformal configuration and each CADP antenna may have individual transmission line feeds. When at least two CADP antennae are disposed in a collinear configuration, the at least two CADP antennae may be aligned in the same orientation (e.g., FIG. 31B) or in an opposite orientation (e.g., FIG. 31A). In the case of the opposite alignment orientation, the first antenna part of the at least two CADP antennae may be formed as one piece and the second antenna part located at the opposite ends of the double length first antenna part or conversely, the second antenna part may be formed as one piece (a double length second antenna part) and the first antenna part of the elements may be on opposite sides of the double length second antenna part. The array may comprise individual transmission line feeds including one each transmission line feed to the vertical polarized antenna of an element and one each transmission line feed to the horizontal polarized antenna of an element, wherein amplitude and phase may be adjusted for each transmission line for radiation pattern shaping, changing pattern peak pointing angle and changing polarization orientation of the resultant electric field vector of the array.

A radome, discussed in the description of the two-slot embodiment of the multi-slot antenna, may also be utilized to protect a CADP antenna or an array of CADP antennae.

Simulation Results

Antenna radiation patterns were obtained using a high frequency simulation program. The radiation patterns of a simulated λ/2 two-slot antenna model illustrated in FIG. 3*b* show excellent patterns in both principal planes of the antenna. The principal planes of the antenna are the x-z plane and the x-y plane. In the simulation, the antenna axis is collinear with the z-axis. With the antenna axis (e.g., vertical longitudinal axis) normal to the surface of the earth an elevation pattern cut lies in the principal x-z plane. The azimuth pattern lies in the x-y plane. FIG. 14 illustrates the 3-dimensional coordinate system used in the antenna model simulation. FIG. 15 illustrates the simulated elevation pattern. The elevation angle is the θ angle measured from 0° at the positive z-axis increasing positive toward the x-y plane. Bore sight is at θ=90° (x-y plane). FIG. 16 illustrates the azimuth pattern. The azimuth angle is the ϕ angle measured from 0° at the positive x-axis increasing positive toward the positive y-axis. The azimuth omni-directional pattern has less than 1 dB amplitude variation and the elevation pattern has approximately a 78° half-power beamwidth. The directivity is approximately 2 dB, similar to that of a λ/2 vertical dipole. FIGS. 15 and 16 also illustrate typical elevation and azimuth far field radiation patterns, respectively, for the tri-slot antenna (e.g., FIG. 11) and four-slot antenna (e.g., FIG. 9).

FIG. 21 and FIG. 22 illustrate simulated typical elevation and azimuth far field radiation patterns for the high gain two-slot antenna discussed above. FIGS. 27 and 28 are common aperture antenna far field elevation patterns for horizontal and vertical polarization, respectively. FIGS. 29 and 30 are common aperture antenna far field azimuth patterns for horizontal and vertical polarization, respectively. As shown in FIGS. 22, 29 and 30, the far field azimuth patterns for horizontal and vertical polarizations represent well-behaved substantially omni-directional patterns (i.e., generally circular), with very little maximum to minimum gain variation (e.g., crest to trough ripple) in omni-directionality of the corresponding antennas. As such, as an example, the antennas described herein may exhibit far field azimuth patterns that are omni-directional with a maximum to minimum gain variation in omni-directionality of less than or equal to 3 dB.

CONCLUSION

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

Additionally, while various discreet embodiments have been described throughout, the individual features of the various embodiments may be combined to form other embodiments not specifically described. The embodiments formed by combining the features of described embodiments are also spiral surface antennas.

What is claimed is:

1. A common aperture dual polarized (CADP) antenna for wireless electromagnetic communications, the antenna comprising:

a first antenna part aligned with a second antenna part along a vertical longitudinal axis of the antenna, wherein:

the first antenna part comprises a slot antenna that emanates a horizontally polarized substantially omni-directional electric field perpendicular to the vertical longitudinal axis of the antenna;

a height of the first antenna part is based on a wavelength of a wireless signal being transceived by the first antenna part;

the second antenna part partially overlaps the first antenna part and comprises a tube coaxial with the first antenna part; and a dipole is formed by the first antenna part and the second antenna part that emanates a vertically polarized electric field parallel to the vertical longitudinal axis of the CADP antenna.

2. The antenna as recited in claim 1, wherein:

the second antenna part has a larger cross-sectional area than the first antenna part to reduce an upward tilt of the vertically polarized electric field and align the vertically polarized electric field with the horizontally polarized omni-directional electric field; and a height of the second antenna part is based on a wavelength of a wireless signal being transceived by the second antenna part.

3. The antenna as recited in claim 1, wherein at least of the first antenna part or the second antenna part has a cross-sectional shape comprising a substantially circular shape, a substantially elliptical shape, a substantially rectangular shape, a substantially triangular shape or a substantially polygonal shape.

4. The antenna as recited in claim 1, further comprising:

a supporting structure comprising a duple-coax transmission line configured coaxial with the tube of the second antenna part, wherein the duple-coax transmission line terminates at an inner supporting plate and is affixed to the inner supporting plate, wherein the duple coaxial transmission line is electrically coupled to the second antenna part; and an interior coaxial line that extends through the duple coaxial transmission line and a clearance hole in the inner supporting plate, wherein a center conductor of the interior coaxial line is electrically coupled to the first antenna part and the inner supporting plate supports the first antenna part.

5. The antenna as recited in claim 4, wherein the supporting structure provides a first feed for the first antenna part and a second feed for the dipole formed by the first antenna part and the second antenna part.

6. The antenna as recited in claim 5, wherein orientations of a horizontal polarized and a vertical polarized omni-directional electric field emanated by the antenna are controlled by applying amplitude and/or phase variations to the first feed and the second feed.

7. The antenna as recited in claim 1, further comprising:

a radome that at least partially surrounds the antenna, wherein the radome connects directly to at least one of an elevating member or a mounting structure, the radome having a cross-sectional shape, the cross-sectional shape to include a substantially circular shape, a substantially elliptical shape, a substantially rectangular shape, a substantially triangular shape or a substantially polygonal shape.

8. The antenna as recited in claim 1, wherein the horizontally polarized substantially omni-directional electric field has a maximum to minimum gain variation in omni-directionality of less than or equal to 3 decibels (dB).

9. An antenna array comprising:

at least the first antenna and the second antenna as recited in claim 1, the first antenna and the second antenna disposed in a linear, a collinear, a planar or a conformal configuration, wherein each of the first antenna and the second antenna has individual transmission line feeds.

10. The antenna array as recited in claim 9, wherein each of the first antenna and the second antenna is disposed in a collinear configuration in a same orientation or in an opposite orientation.

11. The antenna array as recited in claim 9, wherein radiation pattern shaping, changing pattern peak pointing angle and changing polarization orientation of a resultant electric field vector of the antenna array is based on an amplitude and phase on the individual transmission line feeds.

12. The antenna as recited in claim 1, wherein the slot antenna comprises a multi-slot antenna.

13. The antenna as recited in claim 1, wherein the slot antenna comprises a tube having an internal surface and an external surface, the tube forming an internal cavity, the tube forming a slot that extends from the internal surface to the external surface.

14. The antenna as recited in claim 1, wherein the slot antenna comprises an electrically conductive surface shaped to have a spiraling cross-section.

* * * * *